US010553222B2

(12) United States Patent
Chebiyyam et al.

(10) Patent No.: US 10,553,222 B2
(45) Date of Patent: Feb. 4, 2020

(54) INTER-CHANNEL BANDWIDTH EXTENSION SPECTRAL MAPPING AND ADJUSTMENT

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/890,670

(22) Filed: Feb. 7, 2018

(65) Prior Publication Data

US 2018/0261232 A1 Sep. 13, 2018

Related U.S. Application Data

(60) Provisional application No. 62/469,432, filed on Mar. 9, 2017.

(51) Int. Cl.

| | |
|---|---|
| ***G10L 19/008*** | (2013.01) |
| ***H04S 5/02*** | (2006.01) |
| ***G10L 19/16*** | (2013.01) |

(52) U.S. Cl.

CPC ..... *G10L 19/008* (2013.01); *G10L 19/167* (2013.01); *H04S 5/02* (2013.01); *H04S 2420/07* (2013.01)

(58) Field of Classification Search

None

See application file for complete search history.

(56) References Cited

U.S. PATENT DOCUMENTS

2007/0088542 A1* 4/2007 Vos ..... G10L 19/0208 704/219
2011/0257984 A1* 10/2011 Virette ..... G10L 19/26 704/503

(Continued)

FOREIGN PATENT DOCUMENTS

WO 2017139714 8/2017

OTHER PUBLICATIONS

3GPP TS 26.290: "3rd Generation Partnership Project; Technical Specification Group Services and System Aspects; Audio Codec Processing Functions; Extended Adaptive Multi-Rate-Wideband (AMR-WB+) Codec; Transcoding Functions", Version 13.0.0, Release 13, Mobile Competence Centre; 650, Route Des Lucioles; F-06921 Sophia-Antipolis Cedex; France, vol. Sa WG4, No. V13.0.0, Dec. 13, 2015 (Dec. 13, 2015), pp. 1-85, XP051046634 [retrieved on Dec. 13, 2015].

(Continued)

*Primary Examiner* — Antim G Shah

(74) *Attorney, Agent, or Firm* — Moore Intellectual Property Law, PLLC

(57) ABSTRACT

A method includes selecting, at an encoder of a first device, a left channel or a right channel as a non-reference target channel based on a high-band reference channel indicator. The method also includes generating a synthesized non-reference high-band channel based on a non-reference high-band excitation corresponding to the non-reference target channel. The method also includes generating a high-band portion of the non-reference target channel. The method further includes estimating one or more spectral mapping parameters based on the synthesized non-reference high-band channel and the high-band portion of the non-reference target channel. The method also includes applying the one or more spectral mapping parameters to the synthesized non-reference high-band channel to generate a spectrally shaped (Continued)

synthesized non-reference high-band channel. The method further includes generating an encoded bitstream based on the one or more spectral mapping parameters and the spectrally shaped synthesized non-reference high-band channel.

34 Claims, 12 Drawing Sheets

(56) References Cited

U.S. PATENT DOCUMENTS

2015/0380007 A1* 12/2015 Atti ..... G10L 19/032
704/219
2015/0380008 A1* 12/2015 Atti ..... G10L 19/265
704/500

OTHER PUBLICATIONS

International Search Report and Written Opinion—PCT/US2018/017359—ISA/EPO—Apr. 3, 2018.

* cited by examiner

INTER-CHANNEL BANDWIDTH EXTENSION SPECTRAL MAPPING AND ADJUSTMENT

I. CROSS REFERENCE TO RELATED APPLICATIONS

The present application claims priority from U.S. Provisional Patent Application No. 62/469,432 entitled "INTER-CHANNEL BANDWIDTH EXTENSION SPECTRAL MAPPING AND ADJUSTMENT," filed Mar. 9, 2017, which is incorporated herein by reference in its entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include or be coupled to multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the respective distances of the microphones from the sound source. In other implementations, the first audio signal may be delayed with respect to the second audio signal. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal.

IV. SUMMARY

In a particular implementation, a device includes an encoder configured to select a left channel or a right channel as a non-reference target channel based on a high-band reference channel indicator. The encoder is also configured to generate a synthesized non-reference high-band channel based on a non-reference high-band excitation corresponding to the non-reference target channel. The encoder is also configured to generate a high-band portion of the non-reference target channel. The encoder is further configured to estimate one or more spectral mapping parameters based on the synthesized non-reference high-band channel and the high-band portion of the non-reference target channel. The encoder is also configured to apply the one or more spectral mapping parameters to the synthesized non-reference high-band channel to generate a spectrally shaped synthesized non-reference high-band channel. The encoder is further configured to generate an encoded bitstream based on the one or more spectral mapping parameters and the spectrally shaped synthesized non-reference high-band channel. The device also includes a transmitter configured to transmit the encoded bitstream to a second device.

In another particular implementation, a method includes selecting, at an encoder of a first device, a left channel or a right channel as a non-reference target channel based on a high-band reference channel indicator. The method also includes generating a synthesized non-reference high-band channel based on a non-reference high-band excitation corresponding to the non-reference target channel. The method also includes generating a high-band portion of the non-reference target channel. The method further includes estimating one or more spectral mapping parameters based on the synthesized non-reference high-band channel and the high-band portion of the non-reference target channel. The method also includes applying the one or more spectral mapping parameters to the synthesized non-reference high-band channel to generate a spectrally shaped synthesized non-reference high-band channel. The method further includes generating an encoded bitstream based on the one or more spectral mapping parameters and the spectrally shaped synthesized non-reference high-band channel. The method also includes transmitting the encoded bitstream to a second device.

In another particular implementation, a non-transitory computer-readable medium includes instructions that, when executed by an encoder of a first device, cause the encoder to perform operations including selecting a left channel or a right channel as a non-reference target channel based on a high-band reference channel indicator. The operations also include generating a synthesized non-reference high-band channel based on a non-reference high-band excitation corresponding to the non-reference target channel. The operations also include generating a high-band portion of the non-reference target channel. The operations also include estimating one or more spectral mapping parameters based on the synthesized non-reference high-band channel and the high-band portion of the non-reference target channel. The operations also include applying the one or more spectral mapping parameters to the synthesized non-reference high-band channel to generate a spectrally shaped synthesized non-reference high-band channel. The operations also include generating an encoded bitstream based on the one or more spectral mapping parameters and the spectrally shaped synthesized non-reference high-band channel. The operations also include initiating transmission of the encoded bitstream to a second device.

In another particular implementation, a device includes means for selecting a left channel or a right channel as a non-reference target channel based on a high-band reference channel indicator. The device also includes means for generating a synthesized non-reference high-band channel based on a non-reference high-band excitation corresponding to the non-reference target channel. The device also includes means for generating a high-band portion of the non-reference target channel. The device further includes means for estimating one or more spectral mapping parameters based on the synthesized non-reference high-band channel and the high-band portion of the non-reference target channel. The device also includes means for applying the one or more spectral mapping parameters to the synthesized non-reference high-band channel to generate a spectrally shaped synthesized non-reference high-band channel.

The device further includes means for generating an encoded bitstream based on the one or more spectral mapping parameters and the spectrally shaped synthesized non-reference high-band channel. The device also includes means for transmitting the encoded bitstream to a second device.

In another particular implementation, a device includes a decoder configured to generate a reference channel and a non-reference channel from a received low-band bitstream. The low-band bitstream is received from an encoder of a second device. The decoder is also configured to generate a synthesized non-reference high-band channel based on a non-reference high-band excitation corresponding to the non-reference channel. The decoder is further configured to extract one or more spectral mapping parameters from a received spectral mapping bitstream. The spectral mapping bitstream is received from the encoder of the second device. The decoder is also configured to generate a spectrally shaped synthesized non-reference high-band channel by applying the one or more spectral mapping parameters to the synthesized non-reference high-band channel. The decoder is further configured to generate an output signal based at least on the spectrally shaped non-reference high-band channel, the reference channel, and the non-reference target channel. The device also includes a playback device configured to render the output signal. In some implementations, the reference channel and the non-reference target channel may be channels generated at the decoder based on a down-mix bitstream. According to one implementation, the decoder may generate the low-band portions of the left and right channels without generating the reference channel and the non-reference target channel.

In another particular implementation, a method includes generating, at a decoder of a device, a reference channel and a non-reference channel from a received low-band bitstream. The low-band bitstream is received from an encoder of a second device. The method also includes generating a synthesized non-reference high-band channel based on a non-reference high-band excitation corresponding to the non-reference channel. The method further includes extracting one or more spectral mapping parameters from a received spectral mapping bitstream. The spectral mapping bitstream is received from the encoder of the second device. The method also includes generating a spectrally shaped synthesized non-reference high-band channel by applying the one or more spectral mapping parameters to the synthesized non-reference high-band channel. The method further includes generating an output signal based at least on the spectrally shaped non-reference high-band channel, the reference channel, and the non-reference target channel. The method also includes rendering the output signal at a playback device.

In another particular implementation, a non-transitory computer-readable medium includes instructions that, when executed by a decoder of a device, cause the decoder to perform operations including generating a reference channel and a non-reference channel from a received low-band bitstream. The low-band bitstream is received from an encoder of a second device. The operations also include generating a synthesized non-reference high-band channel based on a non-reference high-band excitation corresponding to the non-reference channel. The operations also include extracting one or more spectral mapping parameters from a received spectral mapping bitstream. The spectral mapping bitstream is received from the encoder of the second device. The operations also include generating a spectrally shaped synthesized non-reference high-band channel by applying the one or more spectral mapping parameters to the synthesized non-reference high-band channel. The operations also include generating an output signal based at least on the spectrally shaped non-reference high-band channel, the reference channel, and the non-reference target channel. The operations also include providing the output signal to a playback device for rendering.

In another particular implementation, a device includes means for generating a non-reference channel from a received low-band bitstream. The low-band bitstream is received from an encoder of a second device. The device also includes means for generating a synthesized non-reference high-band channel based on a non-reference high-band excitation corresponding to the non-reference channel. The device also includes means for extracting one or more spectral mapping parameters from a received spectral mapping bitstream. The spectral mapping bitstream is received from the encoder of the second device. The device also includes means for generating a spectrally shaped synthesized non-reference high-band channel by applying the one or more spectral mapping parameters to the synthesized non-reference high-band channel. The device also includes means for generating an output signal based at least on the spectrally shaped non-reference high-band channel, the reference channel, and the non-reference target channel. The device also includes means for rendering the output signal.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
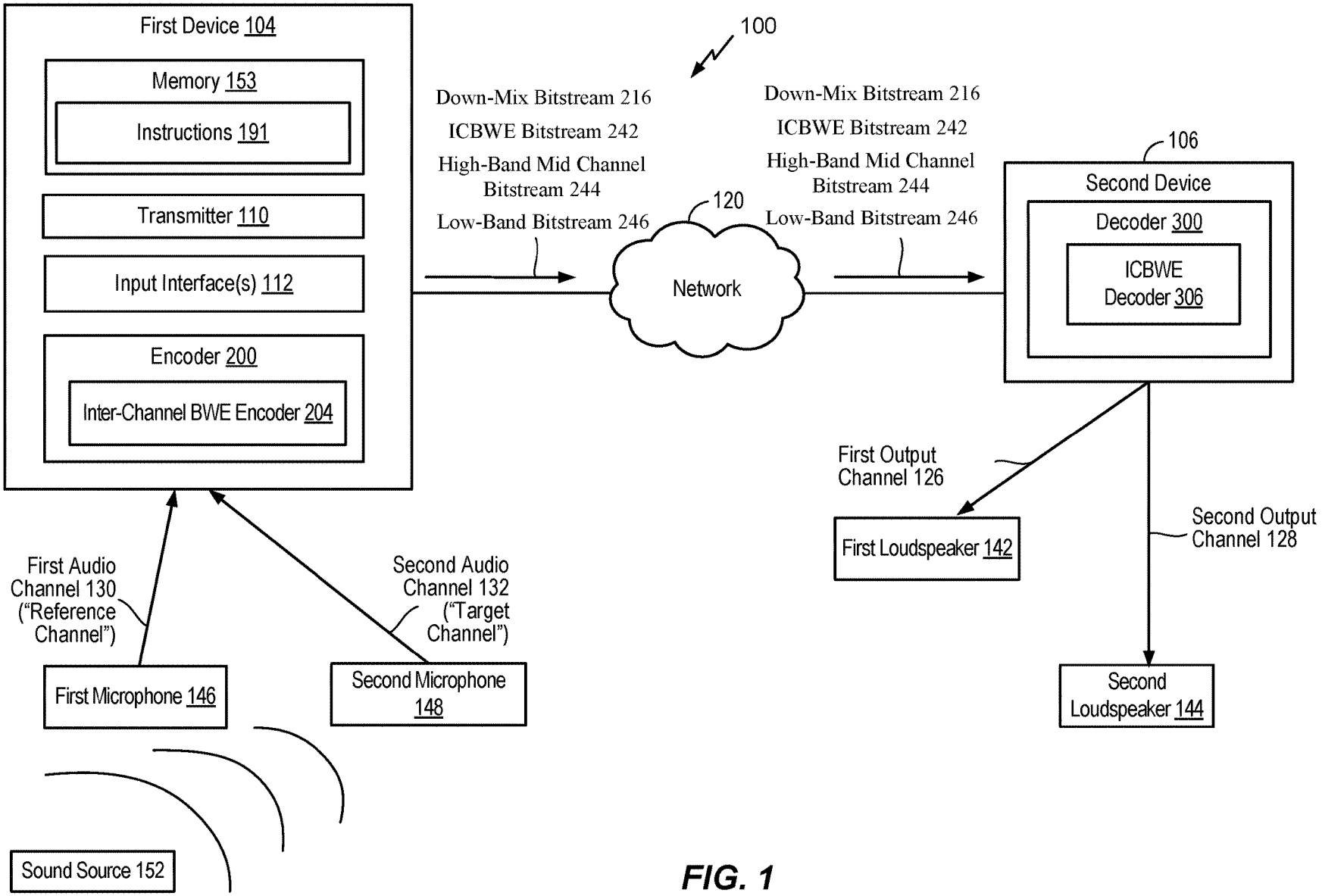
FIG. 1 is a block diagram of a particular illustrative example of a system that includes an encoder operable to estimate one or more spectral mapping parameters and a decoder operable to extract one or more spectral mapping parameters.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded or coded based on a model in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2, S=(L-R)/2, \quad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R), S=c(L-R), \quad \text{Formula 2}$$

where c corresponds to a complex value which is frequency dependent. Generating the Mid channel and the Side channel based on Formula 1 or Formula 2 may be referred to as "downmixing". A reverse process of generating the Left channel and the Right channel from the Mid channel and the Side channel based on Formula 1 or Formula 2 may be referred to as "upmixing".

In some cases, the Mid channel may be based other formulas such as:

$$M=(L+g_D R)/2, \text{ or} \quad \text{Formula 3}$$

$$M=g_1 L+g_2 R \quad \text{Formula 4}$$

where $g_1+g_2=1.0$, and where $g_D$ is a gain parameter. In other examples, the downmix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal misalignment between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The temporal mismatch value may correspond to an amount of temporal delay between receipt of the first audio signal at the first microphone and receipt of the second audio signal at the second microphone. Furthermore, the encoder may determine the temporal mismatch value on a frame-by-frame basis, e.g., based on each 20 milliseconds (ms) speech/audio frame. For example, the temporal mismatch value may correspond to an amount of time that a second frame of the second audio signal is delayed with respect to a first frame of the first audio signal. Alternatively, the temporal mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the temporal mismatch value may always be positive to indicate an amount of delay of the "target" channel relative to the "reference" channel. Furthermore, the temporal mismatch value may correspond to a "non-causal shift" value by which the delayed target channel is "pulled back" in time such that the target channel is aligned (e.g., maximally aligned) with the "reference" channel. The downmix algorithm to determine the mid channel and the side channel may be performed on the reference channel and the non-causal shifted target channel.

The encoder may determine the temporal mismatch value based on the reference audio channel and a plurality of temporal mismatch values applied to the target audio channel. For example, a first frame of the reference audio channel, X, may be received at a first time ($m_1$). A first particular frame of the target audio channel, Y, may be received at a second time ($n_1$) corresponding to a first temporal mismatch value, e.g., $shift1=n_1-m_1$. Further, a second frame of the reference audio channel may be received at a third time ($m_2$). A second particular frame of the target audio channel may be received at a fourth time ($n_2$) corresponding to a second temporal mismatch value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a temporal mismatch value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . t3(ref, chN), where ch1 is the ref channel initially and t1 (·), t2(·), etc. are the functions to estimate the mismatch values. If all temporal mismatch values are positive then ch1 is treated as the reference channel. If any of the mismatch values is a negative value, then the reference channel is reconfigured to the channel that was associated with a mismatch value that resulted in a negative value and the above process is continued until the best selection (i.e., based on maximally decorrelating maximum number of side channels) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc. In such a case, identification of reference and target channels may be based on the varying temporal shift values in the current frame and the estimated temporal mismatch values in the previous frames, and based on the energy or temporal evolution of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular temporal mismatch value. The encoder may generate a first estimated temporal mismatch value based on the comparison values. For example, the first estimated temporal mismatch value may correspond to a comparison value indicating a higher temporal-similarity (or lower difference) between the first frame of the first audio signal and a corresponding first frame of the second audio signal.

The encoder may determine a final temporal mismatch value by refining, in multiple stages, a series of estimated temporal mismatch values. For example, the encoder may first estimate a "tentative" temporal mismatch value based on comparison values generated from stereo pre-processed and re-sampled versions of the first audio signal and the second audio signal. The encoder may generate interpolated comparison values associated with temporal mismatch values proximate to the estimated "tentative" temporal mismatch value. The encoder may determine a second estimated "interpolated" temporal mismatch value based on the interpolated comparison values. For example, the second estimated "interpolated" temporal mismatch value may correspond to a particular interpolated comparison value that indicates a higher temporal-similarity (or lower difference) than the remaining interpolated comparison values and the first estimated "tentative" temporal mismatch value. If the second estimated "interpolated" temporal mismatch value of the current frame (e.g., the first frame of the first audio signal) is different than a final temporal mismatch value of a previous frame (e.g., a frame of the first audio signal that precedes the first frame), then the "interpolated" temporal mismatch value of the current frame is further "amended" to improve the temporal-similarity between the first audio signal and the shifted second audio signal. In particular, a third estimated "amended" temporal mismatch value may correspond to a more accurate measure of temporal-similarity by searching around the second estimated "interpolated" temporal mismatch value of the current frame and the final estimated temporal mismatch value of the previous frame. The third estimated "amended" temporal mismatch value is further conditioned to estimate the final temporal mismatch value by limiting any spurious changes in the temporal mismatch value between frames and further controlled to not switch from a negative temporal mismatch value to a positive temporal mismatch value (or vice versa) in two successive (or consecutive) frames as described herein.

In some examples, the encoder may refrain from switching between a positive temporal mismatch value and a negative temporal mismatch value or vice-versa in consecutive frames or in adjacent frames. For example, the encoder may set the final temporal mismatch value to a particular value (e.g., 0) indicating no temporal-shift based on the estimated "interpolated" or "amended" temporal mismatch value of the first frame and a corresponding estimated "interpolated" or "amended" or final temporal mismatch value in a particular frame that precedes the first frame. To illustrate, the encoder may set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is positive and the other of the estimated "tentative" or "interpolated" or "amended" or "final" estimated temporal mismatch value of the previous frame (e.g., the frame preceding the first frame) is negative. Alternatively, the encoder may also set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is negative and the other of the estimated "tentative" or "interpolated" or "amended" or "final" estimated temporal mismatch value of the previous frame (e.g., the frame preceding the first frame) is positive.

The encoder may select a frame of the first audio signal or the second audio signal as a "reference" or "target" based on the temporal mismatch value. For example, in response to determining that the final temporal mismatch value is positive, the encoder may generate a reference channel or signal indicator having a first value (e.g., 0) indicating that the first audio signal is a "reference" signal and that the second audio signal is the "target" signal. Alternatively, in response to determining that the final temporal mismatch value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final temporal mismatch value is positive, the encoder may estimate a gain value to normalize or equalize the amplitude or power levels of the first audio signal relative to the second audio signal that is offset by the non-causal temporal mismatch value (e.g., an absolute value of the final temporal mismatch value). Alternatively, in response to determining that the final temporal mismatch value is negative, the encoder may estimate a gain value to normalize or equalize the power or amplitude levels of the non-causal shifted first audio signal relative to the second audio signal. In some examples, the encoder may estimate a gain value to normalize or equalize the amplitude or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal temporal mismatch value, and the relative gain parameter. In other implementations, the encoder may generate at least one encoded signal (e.g., a mid channel, a side channel, or both) based on the reference channel and the temporal-mismatch adjusted target channel. The side signal may correspond to a difference between first samples of the first frame of the first audio signal and selected samples of a selected frame of the second audio signal. The encoder may select the selected frame based on the final temporal mismatch value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal temporal mismatch value, the relative gain parameter, the reference channel or signal indicator, or a combination thereof.

The encoder may generate at least one encoded signal (e.g., a mid signal, a side signal, or both) based on the reference signal, the target signal, the non-causal temporal mismatch value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal temporal mismatch value and inter-channel relative gain parameter. The low band parameters, the high band parameters, or a combination thereof, may include a pitch parameter, a voicing parameter, a coder type parameter, a low-band energy parameter, a high-band energy parameter, an envelope parameter (e.g., a tilt parameter), a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal temporal mismatch value, the relative gain parameter, the reference channel (or signal) indicator, or a combination thereof. In the present disclosure, terms such as "determining", "calculating", "shifting", "adjusting", etc. may be used to describe how one or more operations are performed. It should be noted that such terms are not to be construed as limiting and other techniques may be utilized to perform similar operations.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include a memory 153, an encoder 200, a transmitter 110, and one or more input interfaces 112. The memory 153 may be a non-transitory computer-readable medium that includes instructions 191. The instructions 191 may be executable by the encoder 200 to perform one or more of the operations described herein. A first input interface of the input interfaces 112 may be coupled to a first microphone 146. A second input interface of the input interface 112 may be coupled to a second microphone 148. The encoder 200 may include an inter-channel bandwidth extension (ICBWE) encoder 204. The ICBWE encoder 204 may be configured to estimate one or more spectral mapping parameters based on a synthesized non-reference high-band and a non-reference target channel. Additional details associated with the operations of the ICBWE encoder 204 are described with respect to FIGS. 2 and 4-5.

The second device 106 may include a decoder 300. The decoder 300 may include an ICBWE decoder 306. The ICBWE decoder 306 may be configured to extract one or more spectral mapping parameters from a received spectral mapping bitstream. Additional details associated with the operations of the ICBWE decoder 306 are described with respect to FIGS. 3 and 6. The second device 106 may be coupled to a first loudspeaker 142, a second loudspeaker 144, or both. Although not shown, the second device 106 may include other components, such a processor (e.g., central processing unit), a microphone, a receiver, a transmitter, an antenna, a memory, etc.

During operation, the first device 104 may receive a first audio channel 130 (e.g., a first audio signal) via the first input interface from the first microphone 146 and may receive a second audio channel 132 (e.g., a second audio signal) via the second input interface from the second microphone 148. The first audio channel 130 may correspond to one of a right channel or a left channel. The second audio channel 132 may correspond to the other of the right channel or the left channel. A sound source 152 (e.g., a user, a speaker, ambient noise, a musical instrument, etc.) may be closer to the first microphone 146 than to the second microphone 148. Accordingly, an audio signal from the sound source 152 may be received at the input interfaces 112 via the first microphone 146 at an earlier time than via the second microphone 148. This natural delay in the multi-channel signal acquisition through the multiple microphones may introduce a temporal misalignment between the first audio channel 130 and the second audio channel 132.

According to one implementation, the first audio channel 130 may be a "reference channel" and the second audio channel 132 may be a "target channel". The target channel may be adjusted (e.g., temporally shifted) to substantially align with the reference channel. According to another implementation, the second audio channel 132 may be the reference channel and the first audio channel 130 may be the target channel. According to one implementation, the reference channel and the target channel may vary on a frame-to-frame basis. For example, for a first frame, the first audio channel 130 may be the reference channel and the second audio channel 132 may be the target channel. However, for a second frame (e.g., a subsequent frame), the first audio channel 130 may be the target channel and the second audio channel 132 may be the reference channel. For ease of description, unless otherwise noted below, the first audio channel 130 is the reference channel and the second audio channel 132 is the target channel. It should be noted that the reference channel described with respect to the audio channels 130, 132 may be independent from the high-band reference channel indicator that is described below. For example, the high-band reference channel indicator may indicate that a high-band of either channel 130, 132 is the high-band reference channel, and the high-band reference channel indicator may indicate a high-band reference channel which could be either the same channel or a different channel from the reference channel.

Figure 2A:
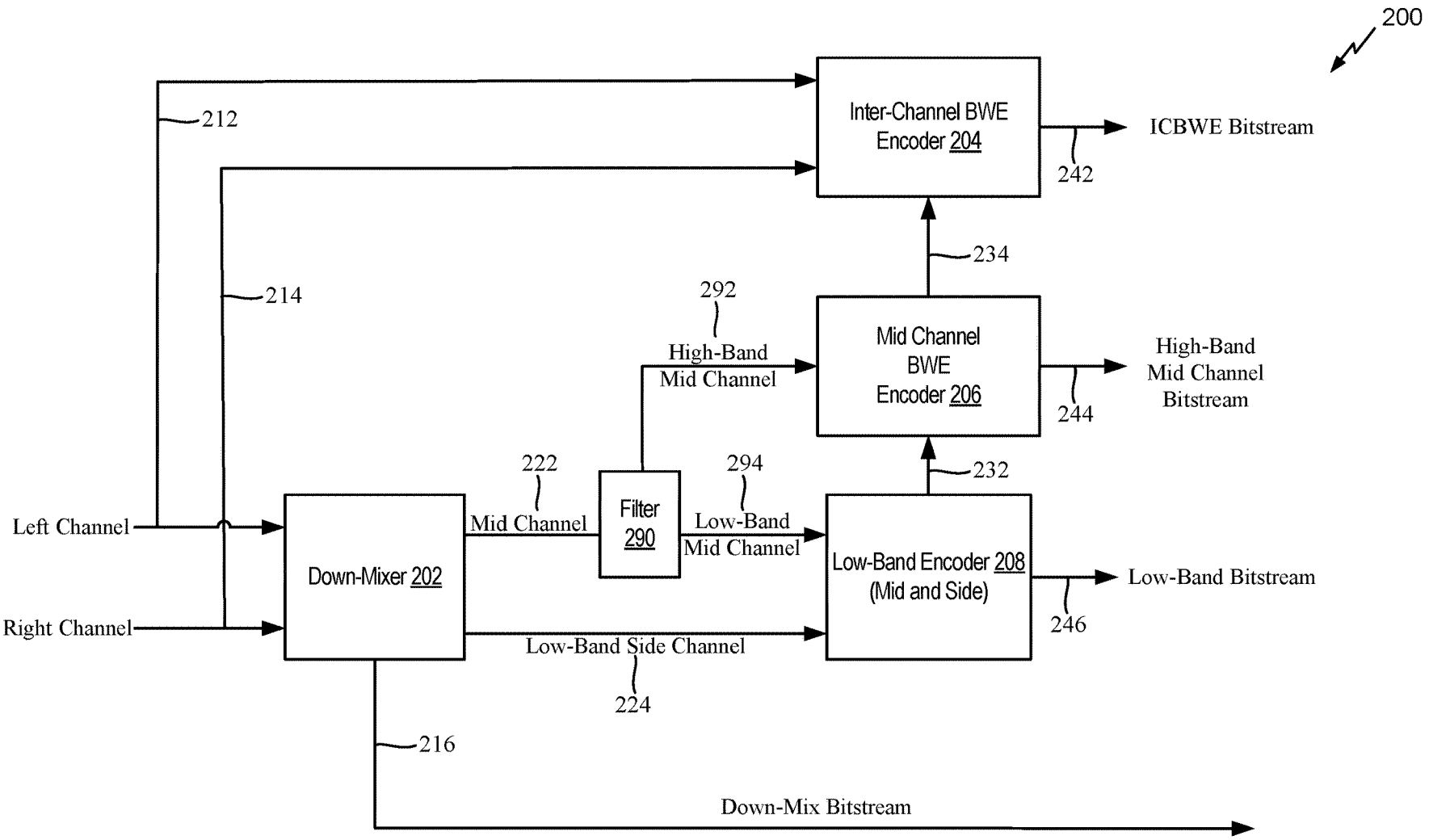
FIG. 2A is a diagram illustrating the encoder of FIG. 1.
Figure 4:
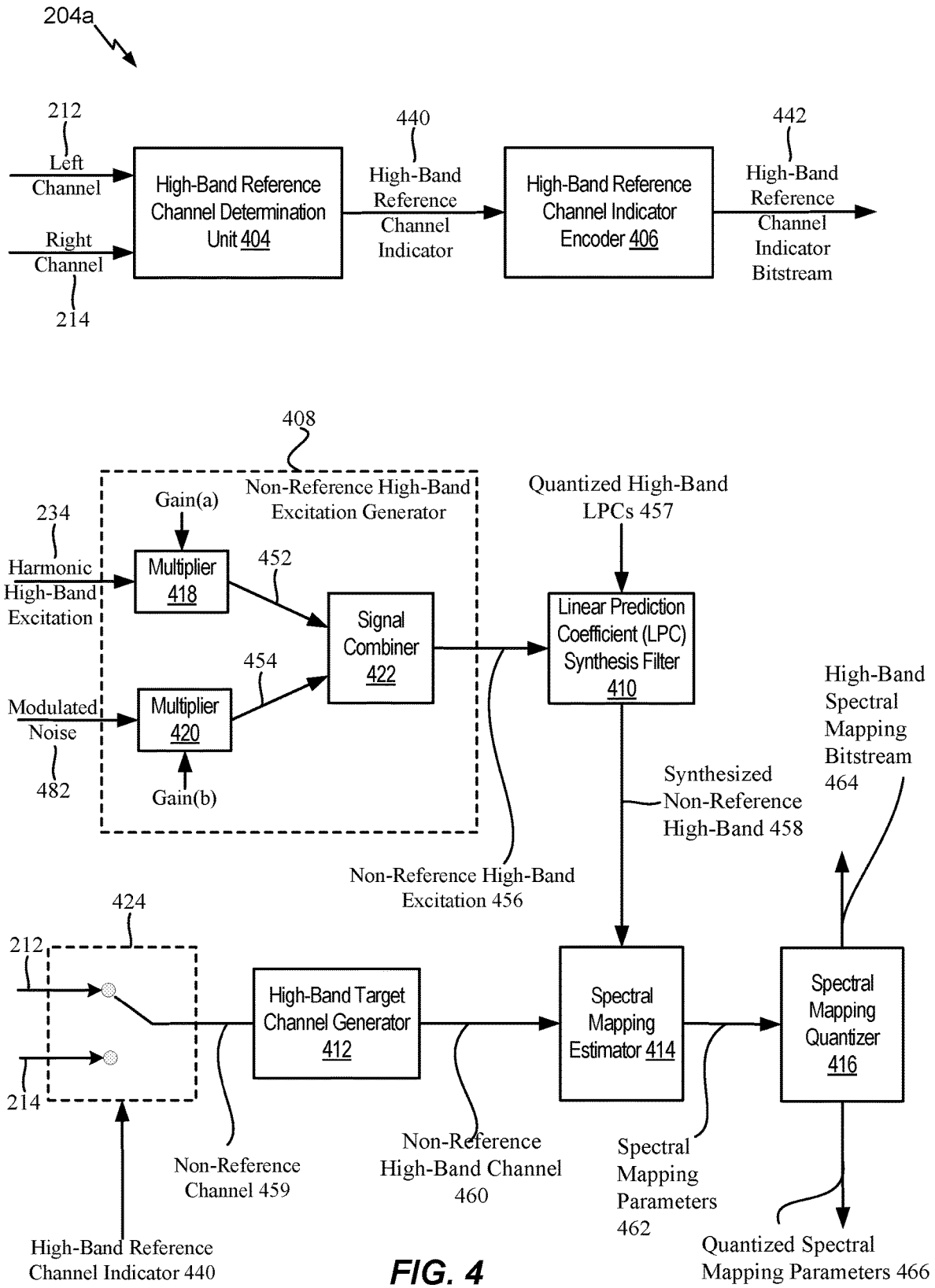
FIG. 4 is a diagram illustrating a first portion of an inter-channel bandwidth extension encoder of the encoder of FIG. 1.
Figure 5:
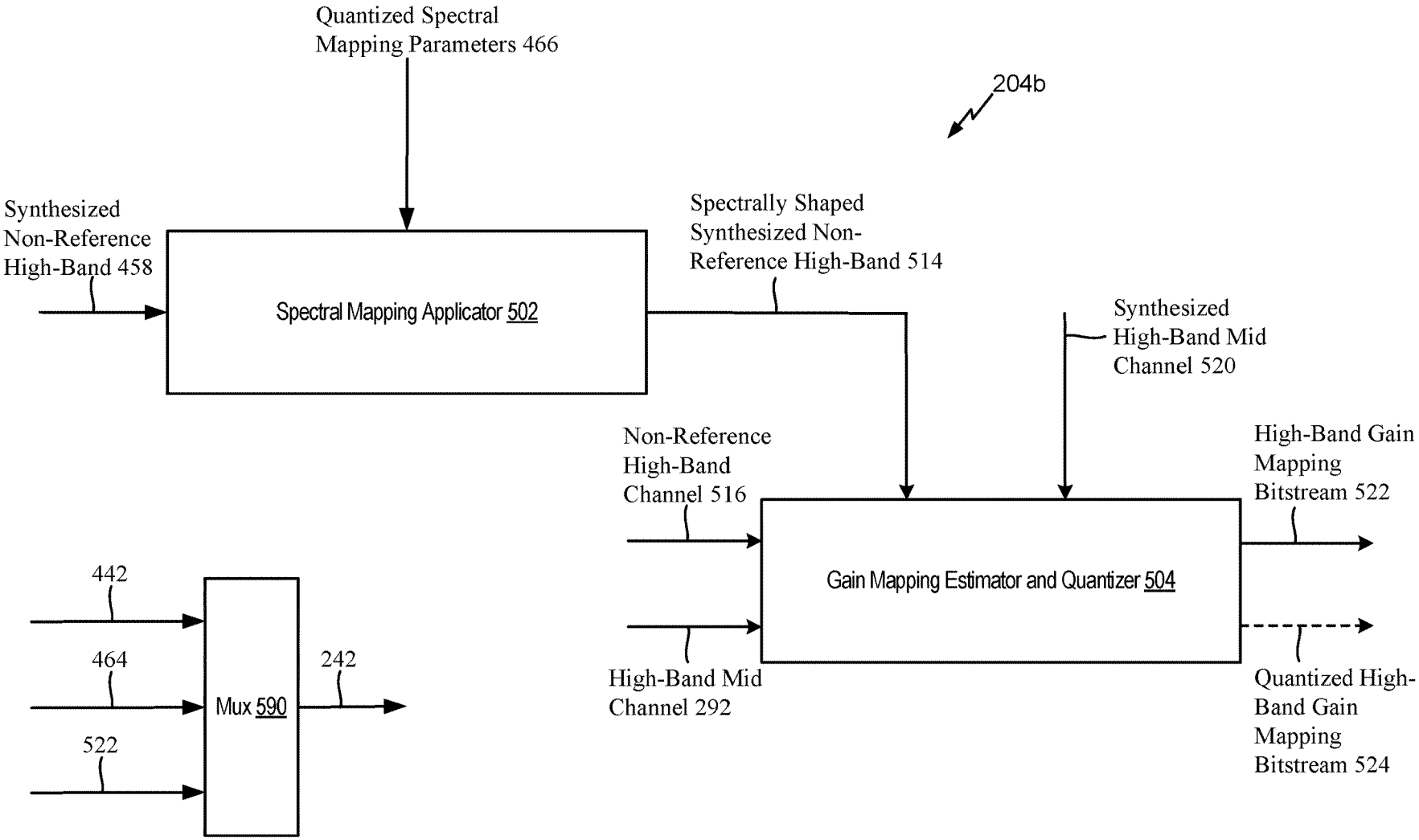
FIG. 5 is a diagram illustrating a second portion of the inter-channel bandwidth extension encoder of the encoder of FIG. 1.

As described in greater detail with respect to FIGS. 2A, 4, and 5, the encoder 200 may generate a down-mix bitstream 216, an ICBWE bitstream 242, a high-band mid channel bitstream 244, and a low-band bitstream 246. The transmitter 110 may transmit the down-mix bitstream 216, the ICBWE bitstream 242, the high-band mid channel bitstream 244, or a combination thereof, via the network 120, to the second device 106. Alternatively, or in addition, the transmitter 110 may store the down-mix bitstream 216, the ICBWE bitstream 242, the high-band mid channel bitstream 244, or a combination thereof, at a device of the network 120 or a local device for further processing or decoding later.

The decoder 300 may perform decoding operations based on the down-mix bitstream 216, the ICBWE bitstream 242, the high-band mid channel bitstream 244, and the low-band bitstream 246. For example, the decoder 300 may generate a first channel (e.g., a first output channel 126) and a second channel (e.g., a second output channel 128) based on the down-mix bitstream 216, the low-band bitstream 246, the ICBWE bitstream 242, and the high-band mid channel bitstream 244. The second device 106 may output the first output channel 126 via the first loudspeaker 142. The second device 106 may output the second output channel 128 via the second loudspeaker 144. In alternative examples, the first output channel 126 and second output channel 128 may be transmitted as a stereo signal pair to a single output loudspeaker.

As described below, the ICBWE encoder 204 of FIG. 1 may estimate spectral mapping parameters based on a maximum-likelihood measure, or an open-loop or a closed-loop spectral distortion reduction measure such that a spectral shape (e.g., the spectral envelope or spectral tilt) of a spectrally shaped synthesized non-reference high-band channel is substantially similar to a spectral shape (e.g., spectral envelope) of a non-reference target channel. The spectral mapping parameters may be transmitted to the decoder 300 in the ICBWE bitstream 242 and used at the decoder 300 to generate the output signals 126, 128 having reduced artifacts and improved spatial balance between left and right channels.

Referring to FIG. 2A, a particular implementation of an encoder 200 operable to estimate spectral mapping parameters is shown. The encoder 200 includes a down-mixer 202, the ICBWE encoder 204, a mid channel BWE encoder 206, a low-band encoder 208, and a filterbank 290.

A left channel 212 and a right channel 214 may be provided to the down-mixer 202. According to one implementation, the left channel 212 and the right channel 214 may be frequency-domain channels (e.g., transform-domain channels). According to another implementation, the left channel 212 and the right channel 214 may be time-domain channels. The down-mixer 202 may be configured to down-mix the left channel 212 and the right channel 214 to generate a down-mix bitstream 216, a mid channel 222, and a low-band side channel 224. Although the low-band side channel 224 is shown to be estimated, in other alternative implementations, a full bandwidth side channel may be alternatively generated and encoded and a corresponding bit-stream may be transmitted to a decoder. The down-mix bitstream 216 may include down-mix parameters (e.g., shift parameters, target gain parameters, reference channel indicator, interchannel level differences, interchannel phase differences, etc.) based on the left channel 212 and the right channel 214. The down-mix bitstream 216 may be transmitted from the encoder 200 to a decoder, such as a decoder 300 of FIG. 3A.

The mid channel 222 may represent an entire frequency band of the channels 212, 214, and the low-band side channel 224 may represent a low-band portion of the channels 212, 214. As a non-limiting example, the mid channel 222 may represent the entire frequency band (20 Hz to 16 kHz) of the channels 212, 214 if the channels 212, 214 are super-wideband channels, and the low-band side channel 224 may represent the low-band portion (e.g., 20 Hz to 8 kHz or 20 Hz to 6.4 kHz) of the channels 212, 214. The mid channel 222 may be provided to the resampling filterbank 290, and the low-band side channel 224 may be provided to the low-band encoder 208.

The resampling filterbank 290 may be configured to separate high-frequency components and low-frequency components of the mid channel 222. To illustrate, the resampling filterbank 290 may separate the high-frequency components of the mid channel 222 to generate a high-band mid channel 292, and the filterbank 290 may separate the low-frequency components of the mid channel 222 to generate a low-band mid channel 294. In the scenario where the coding mode is super-wideband, the high-band mid channel 292 may span from 8 kHz to 16 kHz, and the low-band mid channel 294 may span from 20 Hz to 8 kHz. It should be appreciated that the coding mode and the frequency ranges described herein are merely for illustrative purposes and should not be construed as limiting. In other implementations, the coding mode may be different (e.g., a wideband coding mode, a full-band coding mode, etc.) and/or the frequency ranges may be different. In other implementations, the down-mixer 202 may be configured to directly provide the low-band mid channel 294 and the high-band mid channel 292. In such implementations, filtering operations at the filterbank 290 may be bypassed. The high-band mid channel 292 may be provided to the mid channel BWE encoder 206, and the low-band mid channel 294 may be provided to the low-band encoder 208.

The low-band encoder 208 may be configured to encode the low-band mid channel 294 and the low-band side channel 224 to generate a low-band bitstream 246. In some implementations, one or more of the following steps including, generation of the low-band side channel 224, encoding of the low-band side channel 224, and including the information corresponding to the low-band side channel as a part of the low-band bit-stream 246, may be bypassed. According to one implementation, the low-band encoder 208 may include a mid channel low-band encoder (e.g., not shown and based on ACELP or TCX coding) configured to generate a low-band mid channel bitstream by encoding the low-band mid channel 294. The low-band encoder 208 may also include a side channel low-band encoder (e.g., not shown and based on ACELP or TCX coding) configured to generate a low-band side channel bitstream by encoding the low-band side channel 224. The low-band bitstream 246 may be transmitted from the encoder 200 to a decoder (e.g., the decoder 300 of FIG. 3A).

The low-band encoder 208 may also generate a low-band excitation signal 232 that is provided to the mid channel BWE encoder 206. The mid channel BWE encoder 206 may be configured to encode the high-band mid channel 292 to generate a high-band mid channel bitstream 244. For example, the mid channel BWE encoder 206 may estimate linear prediction coefficients (LPCs), gain shape parameters, gain frame parameters, etc., based on the low-band excitation signal 232 and the high-band mid channel 292 to generate the high-band mid channel bitstream 244. According to one implementation, the mid channel BWE encoder 206 may encode the high-band mid channel 292 using time domain bandwidth extension. The high-band mid channel bitstream 244 may be transmitted from the encoder 200 to a decoder (e.g., the decoder 300 of FIG. 3A).

The mid channel BWE encoder 206 may provide one or more parameters 234 to the inter-channel BWE encoder 204. The one or more parameters 234 may include a harmonic high-band excitation (e.g., the harmonic high-band excitation 237 of FIG. 2B), modulated noise (e.g., the modulated noise 482 of FIG. 4), quantized gain shapes, quantized linear prediction coefficients (LPCs), quantized gain frames, etc. The left channel 212 and the right channel 214 may also be provided to the inter-channel BWE encoder 204. The inter-channel BWE encoder 204 may be configured to extract gain mapping parameters associated with the channels 212, 214, spectral shape mapping parameters associated with the channels 212, 214, etc., to facilitate mapping the one or more parameters 234 to the channels 212, 214. The extracted parameters may be included in the ICBWE bitstream 242. The ICBWE bitstream 242 may be transmitted from the encoder 200 to the decoder. Operations associated with the ICBWE encoder 204 are described in further detail with respect to FIGS. 4-5. Thus, the ICBWE encoder 204 of FIG. 2A may estimate spectral shape mapping parameters, quantize the spectral shape mapping parameters into the ICBWE bitstream 242, and transmit the ICBWE bitstream 242 to the decoder.

The encoder 200 of FIG. 2A may receive two channels 212, 214 and perform a downmix of the channels 212, 214 to generate the mid channel 222, the down-mix bitstream 216, and, in some implementations, the low-band side channel 224. The encoder 200 may encode the mid channel 222 and the low-band side channel 224 using the low-band encoder 208 to generate the low-band bitstream 246. The encoder 200 may also generate mapping information indicating how to map left and right decoded high-band channels (at the decoder) from a high-band mid channel (at the decoder) using the ICBWE encoder 204.

The ICBWE encoder 204 of FIG. 2A may estimate spectral mapping parameters based on a maximum-likelihood measure, or an open-loop or a closed-loop spectral distortion reduction measure such that a spectral envelope of a spectrally shaped synthesized non-reference high-band channel is substantially similar to a spectral envelope of a non-reference target channel. The spectral mapping parameters may be transmitted to the decoder 300 in the ICBWE bitstream 242 and used at the decoder 300 to generate the output signals having reduced artifacts.

Figure 2B:
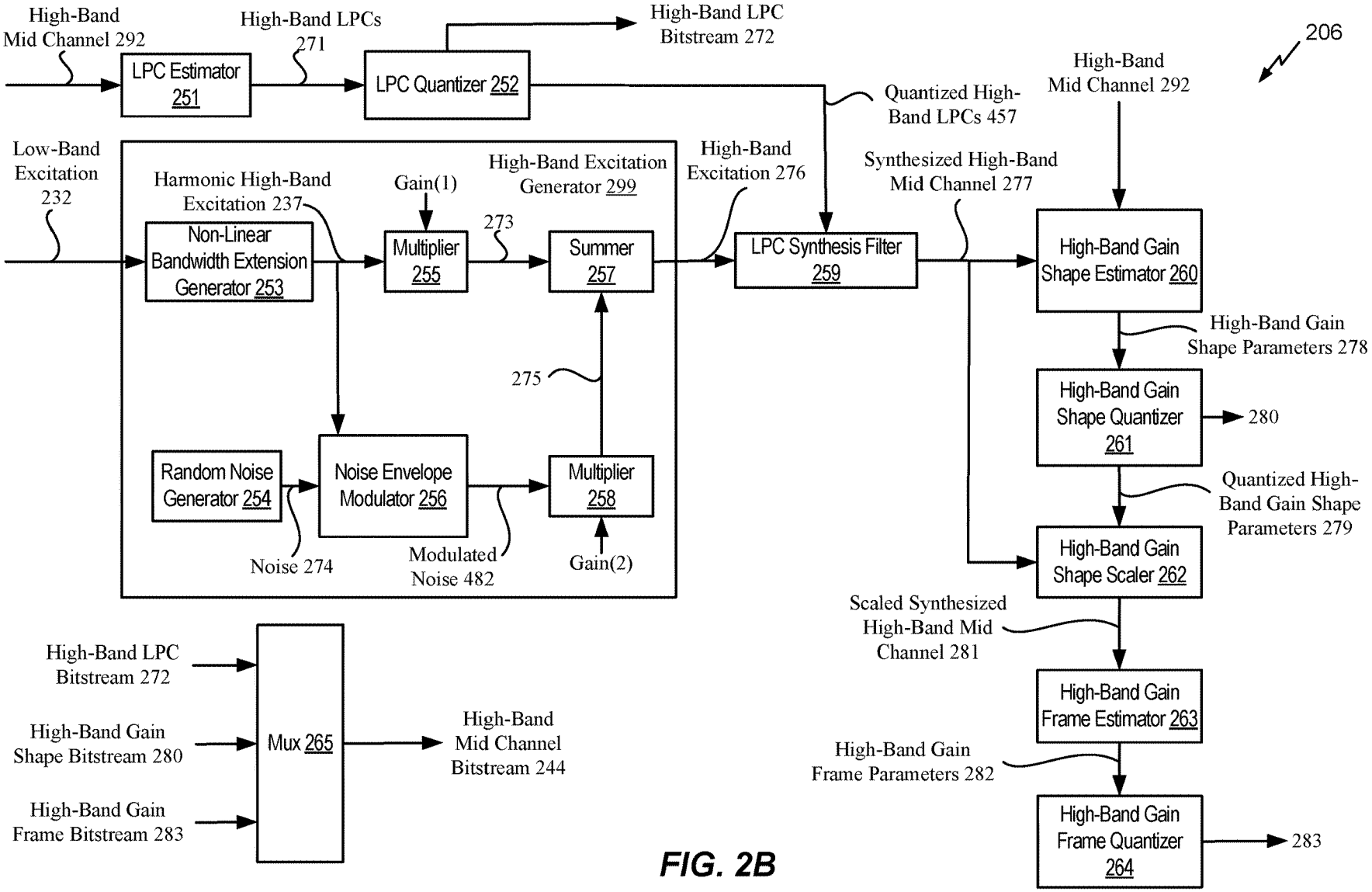
FIG. 2B is a diagram illustrating a mid channel bandwidth extension (BWE) encoder.

Referring to FIG. 2B, a particular implementation of the mid channel BWE encoder 206 is shown. The mid channel BWE encoder 206 includes a linear prediction coefficient (LPC) estimator 251, an LPC quantizer 252, and an LPC synthesis filter 259. The high-band mid channel 292 is provided to the LPC estimator 251, and the LPC estimator 251 may be configured to predict high-band LPCs 271 based on the high-band mid channel 292. The high-band LPCs 271 are provided to the LPC quantizer 252. The LPC quantizer 252 may be configured to quantize the high-band LPCs to generate quantized high-band LPCs 457 and a high-band LPC bitstream 272. The quantized LPCs 457 are provided to the LPC synthesis filter 259, and the high-band LPC bitstream is provided to a multiplexer 265.

The mid channel BWE encoder 206 also includes a high-band excitation generator 299 that includes a non-linear BWE generator 253, a random noise generator 254, a signal multiplier 255, a noise envelope modulator 256, a summer 257, and a multiplier 258. The low-band excitation 232 from the low-band encoder 208 is provided to the non-linear BWE generator 253. The non-linear BWE generator 253 may perform a non-linear extension on the low-band excitation 232 to generate a harmonic high-band excitation 237. The harmonic high-band excitation 237 may be included in the one or more parameters 234. The harmonic high-band excitation 237 is provided to the signal multiplier 255 and the noise envelope modulator 256. The signal multiplier may be configured to adjust the harmonic high-band excitation 237 based on a gain factor (Gain(1)) to generate a gain-adjusted harmonic high-band excitation 273. The gain-adjusted harmonic high-band excitation 273 is provided to the summer 257.

The random noise generator 254 may be configured to generate noise 274 that is provided to the noise envelope modulator 256. The noise envelope modulator 256 may be configured to modulate the noise 274 based on the harmonic high-band excitation 237 to generate modulated noise 482. The modulated noise 482 is provided to the signal multiplier 258. The signal multiplier 258 may be configured to adjust the modulated noise 482 based on a gain factor (Gain(2)) to generate gain-adjusted modulated noise 275. The gain-adjusted modulated noise 275 is provided to the summer 257, and the summer 257 may be configured to add the gain-adjusted harmonic high-band excitation 273 and the gain-adjusted modulated noise 275 to generate a high-band excitation 276. The high-band excitation 276 is provided to the LPC synthesis filter 259.

It should be noted that in some implementations Gain(1) and Gain(2) may be vectors with each value of the vector corresponding to a scaling factor of the corresponding signal in subframes.

The LPC synthesis filter 259 may be configured to apply the quantized LPCs 457 to the high-band excitation 276 to generate a synthesized high-band mid channel 277. The synthesized high-band mid channel 277 is provided to a high-band gain shape estimator 260 and to a high-band gain shape scaler 262. The high-band mid channel 292 is also provided to the high-band gain shape estimator 260. The high-band gain shape estimator 260 may be configured to generate high-band gain shape parameters 278 based on the high-band mid channel 292 and the synthesized high-band mid channel 277. The high-band gain shape parameters 278 are provided to a high-band gain shape quantizer 261.

The high-band gain shape quantizer 261 may be configured to quantize the high-band gain shape parameters 278 and generate quantized high-band gain shape parameters 279. The quantized high-band gain shape parameters 279 are provided to the high-band gain shape scaler 262. The high-band gain shape quantizer 261 may also be configured to generate a high-band gain shape bitstream 280 that is provided to the multiplexer 265.

The high-band gain shape scaler 262 may be configured to scale the synthesized high-band mid channel 277 based on the quantized high-band gain shape parameters 279 to generate a scaled synthesized high-band mid channel 281. The scaled synthesized high-band mid channel 281 is provided to a high-band gain frame estimator 263. The high-band gain frame estimator 263 may be configured to estimate high-band gain frame parameters 282 based on the scaled synthesized high-band mid channel 281. The high-band gain frame parameters 282 are provided to a high-band gain frame quantizer 264.

The high-band gain frame quantizer 264 may be configured to quantize the high-band gain frame parameters 282 to generate a high-band gain frame bitstream 283. The high-band gain frame bitstream 283 is provided to the multiplexer 265. The multiplexer 265 may be configured to combine the high-band LPC bitstream 272, the high-band gain shape bitstream 280, the high-band gain frame bitstream 283, and other information to generate the high-band mid channel bitstream 244. According to one implementation, the other information may include information associated with the modulated noise 482, the harmonic high-band excitation 237, the quantized high-band LPCs 457, etc. As described in greater detail with respect to FIG. 4, the ICBWE encoder 204 may use the information provided to the multiplexer 265 for signal processing operations.

Figure 3A:
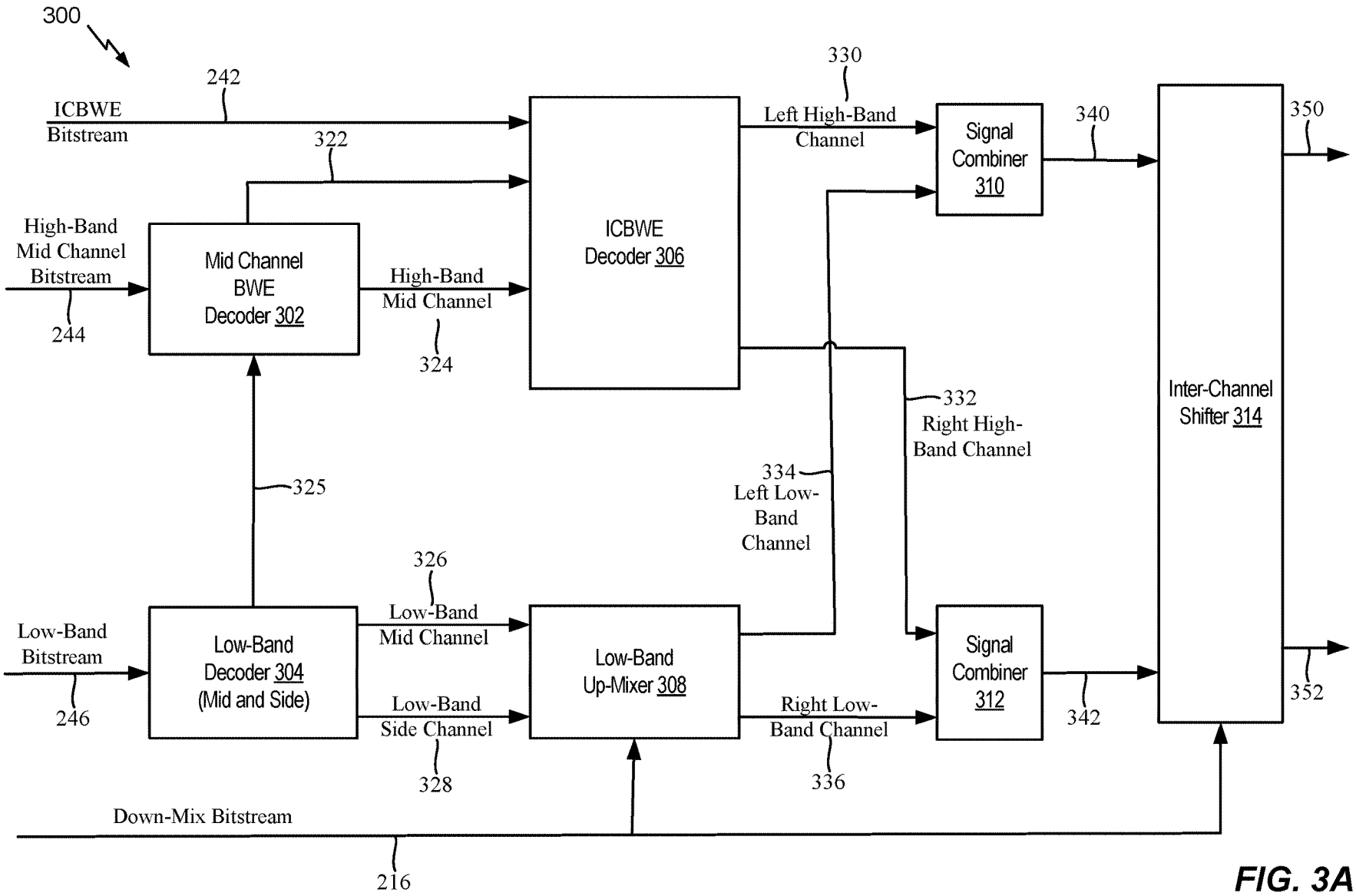
FIG. 3A is a diagram illustrating the decoder of FIG. 1.

Referring to FIG. 3A, a particular implementation of the decoder 300 operable to perform spectral shape mapping is shown. The decoder 300 includes a mid channel BWE decoder 302, a low-band decoder 304, an ICBWE decoder 306, a low-band up-mixer 308, a signal combiner 310, a signal combiner 312, and an inter-channel shifter 314.

The low-band bitstream 246, transmitted from the encoder 200, may be provided to the low-band decoder 304. As described above, the low-band bitstream 246 may include the low-band mid channel bitstream and the low-band side channel bitstream. The low-band decoder 304 may be configured to decode the low-band mid channel bitstream to generate a low-band mid channel 326 that is provided to the low-band up-mixer 308. The low-band decoder 304 may also be configured to decode the low-band side channel bitstream to generate a low-band side channel 328 that is provided to the low-band up-mixer 308. The low-band decoder 304 may also be configured to generate a low-band excitation signal 325 that is provided to the mid channel BWE decoder 302.

The mid channel BWE decoder 302 may be configured to decode the high-band mid channel bitstream 244 based on the low-band excitation signal 325 to generate one or more parameters 322 (e.g., a harmonic high-band excitation, modulated noise, quantized gain shapes, quantized linear prediction coefficients (LPCs), quantized gain frames, etc.) and a high-band mid channel 324. The one or more parameters 322 may correspond to the one or more parameters 234 of FIG. 2A. According to one implementation, the mid channel BWE decoder 302 may use time domain bandwidth extension decoding to decoder the high-band mid channel bitstream 244. The one or more parameters 322 and the high-band mid channel 324 are provided to the ICBWE decoder 306.

The ICBWE bitstream 242 may also be provided to the ICBWE decoder 306. The ICBWE decoder 306 may be configured to generate left high-band channel 330 and a right high-band channel 332 based on the ICBWE bitstream 242, the one or more parameters 322, and the high-band mid channel 324. Thus, based on the ICBWE bitstream 242 and signals and parameters from the mid channel BWE decoding, the ICBWE decoder 306 may generate the decoded left and right high-band channels 330, 332. Operations associated with the ICBWE decoder 306 are described in further detail with respect to FIG. 6. The left high-band channel 330 is provided to the signal combiner 310, and the right high-band channel 332 is provided to the signal combiner 312. The low-band up-mixer 308 may be configured to up-mix the low-band mid channel 326 and the low-band side channel 328 based on the down-mix bitstream 216 to generate a left low-band channel 334 and a right low-band channel 336. The left low-band channel 334 is provided to the signal combiner 310, and the right low-band channel 336 is provided to the signal combiner 312.

The signal combiner 310 may be configured to combine the left high-band channel 330 and the left low-band channel 334 to generate an unshifted left channel 340. The unshifted left channel 340 is provided to the inter-channel shifter 314. The signal combiner 312 may be configured to combine the right high-band channel 332 and the right low-band channel 336 to generate an unshifted right channel 342. The unshifted right channel 342 is provided to the inter-channel shifter 314. It should be noted that in some implementations, operations associated with the inter-channel shifter 314 may be bypassed. For example, if the down-mixer at the corresponding encoder is not configured to shift any of the channels prior to mid channel and side channel generation, operations associated with the inter-channel shifter 314 may be bypassed. The inter-channel shifter 314 may be configured to shift the unshifted left channel 340 based on the shift information associated with the down-mix bitstream 216 to generate a left channel 350. The inter-channel shifter 314 may also be configured to shift the unshifted right channel 342 based on the shift information associated with the down-mix bitstream 216 to generate a right channel 352. For example, the inter-channel shifter 314 may use the shift information from the down-mix bitstream 216 to shift the unshifted left channel 340, the unshifted right channel 342, or a combination thereof, to generate the left and right channels 350, 352. According to one implementation, the left channel 350 is a decoded version of the left channel 212, and the right channel 352 is a decoded version of the right channel 214.

Figure 3B:
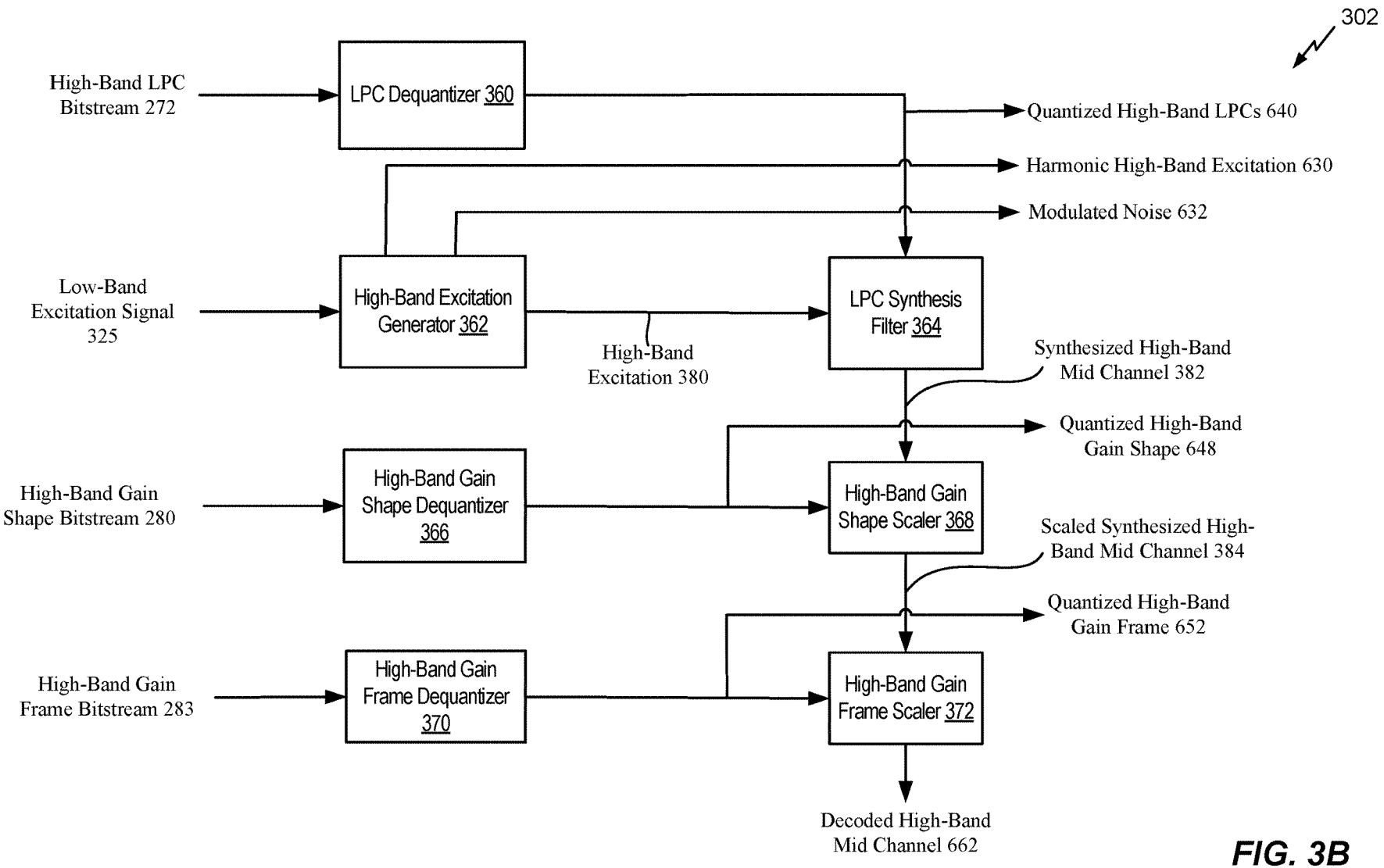
FIG. 3B is a diagram illustrating a mid channel BWE decoder.

Referring to FIG. 3B, a particular implementation of the mid channel BWE decoder 302 is shown. The mid channel BWE decoder 302 includes an LPC dequantizer 360, a high-band excitation generator 362, an LPC synthesis filter 364, a high-band gain shape dequantizer 366, a high-band gain shape scaler 368, a high-band gain frame dequantizer 370, and a high-band gain frame scaler 372.

The high-band LPC bitstream 272 is provided to the LPC dequantizer 360. The LPC dequantizer may extract quantized high-band LPCs 640 from the high-band LPC bitstream 272. As described with respect to FIG. 6, the quantized high-band LPCs 640 may be used by the ICBWE decoder 306 for signal processing operations.

The low-band excitation signal 325 is provided to the high-band excitation generator 362. The high-band excitation generator 362 may generate a harmonic high-band excitation 630 based on the low-band excitation signal 325 and may generate modulated noise 632. As described with respect to FIG. 6, the harmonic high-band excitation 630 and the modulated noise 632 may be used by the ICBWE decoder 306 for signal processing operations. The high-band excitation generator 362 may also generate a high-band excitation 380. The high-band excitation generator 362 may be configured to operate in a substantially similar manner as the high-band excitation generator 299 of FIG. 2B. For example, the high-band excitation generator 362 may perform similar operations on the low-band excitation signal 325 (as the high-band excitation generator 299 performs on the low-band excitation 232) to generate the high-band excitation 380. According to one implementation, the high-band excitation 380 may be substantially similar to the high-band excitation 276 of FIG. 2B. The high-band excitation 380 is provided to the LPC synthesis filter 364. The LPC synthesis filter 364 may apply the quantized high-band LPCs 640 to the high-band excitation 380 to generate a synthesized high-band mid channel 382. The synthesized high-band mid channel 382 is provided to the high-band gain shape scaler 368.

The high-band gain shape bitstream 280 is provided to the high-band gain shape dequantizer 366. The high-band gain shape dequantizer 366 may be configured to extract a quantized high-band gain shape 648 from the high-band gain shape bitstream 280. The quantized high-band gain shape 648 is provided to the high-band gain shape scaler 368 and to the ICBWE decoder 306 for signal processing operations, as described with respect to FIG. 6. The high-band gain shape scale 368 may be configured to scale the synthesized high-band mid channel 382 based on the quantized high-band gain shape 648 to generate a scaled synthesized high-band mid channel 384. The scaled synthesized high-band mid channel 384 is provided to the high-band gain frame scaler 372.

The high-band gain frame bitstream 283 is provided to the high-band gain frame dequantizer 370. The high-band gain frame dequantizer 370 may be configured to extract a quantized high-band gain frame 652 from the high-band gain frame bitstream 283. The quantized high-band gain frame 652 is provided to the high-band gain frame scaler 372 and to the ICBWE decoder 306 for signal processing operations, as described with respect to FIG. 6. The high-band gain frame scaler 372 may apply the quantized high-band gain frame 652 to the scaled synthesized high-band mid channel 384 to generate a decoded high-band mid channel 662. The decoded high-band mid channel 662 is provided to the ICBWE decoder 306 for signal processing operations, as described with respect to FIG. 6.

Referring to FIGS. 4-5, a particular implementation of the ICBWE encoder 204 is shown. A first portion 204*a* of the ICBWE encoder 204 is shown in FIG. 4, and a second portion 204*b* of the ICBWE encoder 204 is shown in FIG. 5.

The first portion 204*a* of the ICBWE encoder 204 includes a high-band reference channel determination unit 404 and a high-band reference channel indicator encoder 406. The left channel 212 and the right channel 214 are provided to the high-band reference channel determination unit 404. The high-band reference channel determination unit 404 may be configured to determine whether the left channel 212 or the right channel 214 is the high-band reference channel. For example, the high-band reference channel determination unit 404 may generate a high-band reference channel indicator 440 indicating whether the left channel 212 or the right channel 214 is used to estimate the high-band non-reference channel 459. The high-band reference channel indicator 440 may be estimated based on the left and right channel 212, 214 energies, the inter-channel shift between the left and right channels 212, 214, the reference channel indicator generated at the down-mix module, the reference channel indicator based on the non-casual shift estimation, and the left and right high-band channel energies.

According to one implementation, the high-band reference channel indicator 440 may be determined using multi-stage techniques where each stage improves an output of a previous stage to determine the high-band reference channel indicator 440. For example, at a first stage, the high-band reference channel determination unit 404 may generate the high-band reference channel indicator 440 based on a reference signal. To illustrate, the high-band reference channel determination unit 404 may generate the high-band reference channel indicator 440 to indicate that the right channel 214 is designated as a high-band reference channel in response to determining that the reference signal indicates that the second audio signal 132 (e.g., a right audio signal) is designated as a reference signal. Alternatively, the high-band reference channel determination unit 404 may generate the high-band reference channel indicator 440 to indicate that the left channel 212 is designated as a high-band reference channel in response to determining that the reference signal indicates that the first audio signal 130 (e.g., a left audio signal) is designated as a reference signal.

At a second stage, the high-band reference channel determination unit 404 may refine (e.g., update) the high-band reference channel indicator 440 based on a gain parameter, a first energy associated with the left channel 212, a second energy associated with the right channel 214, or a combination thereof. For example, the high-band reference channel determination unit 404 may set (e.g., update) the high-band reference channel indicator 440 to indicate that the left channel 212 is designated as a reference channel and that the right channel 214 is designated as a non-reference channel in response to determining that the gain parameter satisfies a first threshold, that a ratio of the first energy (e.g., the left full-band energy) and the right energy (e.g., the right full-band energy) satisfies a second threshold, or both. As another example, the high-band reference channel determination unit 404 may set (e.g., update) the high-band reference channel indicator 440 to indicate that the right channel 214 is designated as a reference channel and that the left channel 212 is designated as a non-reference channel in response to determining that the gain parameter fails to satisfy the first threshold, that the ratio of the first energy (e.g., the left full-band energy) and the right energy (e.g., the right full-band energy) fails to satisfy the second threshold, or both.

At a third stage, the high-band reference channel determination unit 404 may refine (e.g., further update) the high-band reference channel indicator 440 based on the left energy and the right energy. For example, the high-band reference channel determination unit 404 may set (e.g., update) the high-band reference channel indicator 440 to indicate that the left channel 212 is designated as a reference channel and that the right channel 214 is designated as a non-reference channel in response to determining that a ratio of the left energy (e.g., the left HB energy) and the right energy (e.g., the right HB energy) satisfies a threshold. As another example, the high-band reference channel determination unit 404 may set (e.g., update) the high-band reference channel indicator 440 to indicate that the right channel 214 is designated as a reference channel and that the left channel 212 is designated as a non-reference channel in response to determining that a ratio of the left energy (e.g., the left HB energy) and the right energy (e.g., the right HB energy) fails to satisfy a threshold. The high-band reference channel indicator encoder 406 may encode the high-band reference channel indicator 440 to generate a high-band reference channel indicator bitstream 442.

The first portion 204*a* of the ICBWE encoder 204 also includes a non-reference high-band excitation generator 408, a linear prediction coefficient (LPC) synthesis filter 410, a high-band target channel generator 412, a spectral mapping estimator 414, and a spectral mapping quantizer 416. The non-reference high-band excitation generator 408 includes a signal multiplier 418, a signal multiplier 420, and a signal combiner 422.

The non-linear harmonic high-band excitation 237 is provided to the signal multiplier 418, and modulated noise 482 is provided to the signal multiplier 420. In a particular implementation, the non-linear harmonic high-band excitation 237 may be based on a harmonic modeling (e.g., (·)^2 or |·|) that is different than the harmonic modeling used for the mid high-band excitation 232 generation. In an alternate implementation, the non-linear harmonic high-band excitation 237 may be based on the non-reference low band excitation signal. The modulated noise 482 may be based on the envelope modulated noise of the non-linear harmonic high-band excitation signal 237 or the high-band excitation signal 232. In another alternate implementation, the modulated noise 482 may be random noise that is temporally shaped based on a whitened non-linear harmonic high-band excitation signal 237. The temporal shaping may be based on a voice-factor controlled first-order adaptive filter.

The signal multiplier 418 applies a gain (Gain(a)) to the harmonic high-band excitation 237 to generate a gain-adjusted harmonic high-band excitation 452, and the signal multiplier 420 applies a gain (Gain(b)) to the modulated noise 482 to generate gain-adjusted modulated noise 454. The gain-adjusted harmonic high-band excitation 452 and the gain-adjusted modulated noise 454 are provided to the signal combiner 422. The signal combiner 422 may be configured to combine the gain-adjusted harmonic high-band excitation 452 and the gain-adjusted modulated noise 454 to generate a non-reference high-band excitation 456. The non-reference high-band excitation 456 may be generated in a similar manner as the high-band mid channel excitation. However, the gains (Gain(a) and Gain(b)) may be modified versions of the gains used to generate the high-band mid channel excitation based on the relative energies of the high-band reference and high-band non-reference channels, the noise floor of the high-band non-reference channel, etc.

It should be noted that in some implementations Gain(a) and Gain(b) may be vectors with each value of the vector corresponding to a scaling factor of the corresponding signal in subframes.

The mixing gains (Gain(a) and Gain(b)) may also be based on the voice factors corresponding to a high-band mid channel, a high-band non-reference channel, or derived from the low-band voice factor or voicing information. The mixing gains (Gain(a) and Gain(b)) may also be based on the spectral envelope corresponding to the high-band mid channel and the high-band non-reference channel. In another alternate implementation, the mixing gains (Gain(a) and Gain(b)) may be based on the number of talkers or background sources in the signal and the voiced-unvoiced characteristic of the left (or reference, target) and right (or target, reference) channels.

The non-reference high-band excitation 456 is provided to the LPC synthesis filter 410. The LPC synthesis filter 410 may be configured to generate a synthesized non-reference high-band 458 based on the non-reference high-band excitation 456 and quantized high-band LPCs 457 (e.g., LPCs of the high-band mid channel). For example, the LPC synthesis filter 410 may apply the quantized high-band LPCs 457 to the non-reference high-band excitation 456 to generate the synthesized non-reference high-band 458. The synthesized non-reference high-band 458 is provided to the spectral mapping estimator 414.

The high-band reference channel indicator 440 may be provided (as a control signal) to a switch 424 that receives the left channel 212 and the right channel 214 as inputs. Based on the high-band reference channel indicator 440, the switch 424 may provide either the left channel 212 or the right channel 214 to the high-band target channel generator 412 as a non-reference channel 459. For example, if the high-band reference channel indicator 440 indicates that the left channel 212 is the reference channel, the switch 424 may provide the right channel 214 to the high-band target channel generator 412 as the non-reference channel 459. If the high-band reference channel indicator 440 indicates that the right channel 214 is the reference channel, the switch 424 may provide the left channel 212 to the high-band target channel generator 412 as the non-reference channel 459.

The high-band target channel generator 412 may filter low-band signal components of the non-reference channel 459 to generate a non-reference high-band channel 460 (e.g., the high-band portion of the non-reference channel 459). In some implementations, the non-reference high-band channel 460 may be spectrally flipped based on further signal processing operations (e.g., a spectral flip operation). The non-reference high-band channel 460 is provided to the spectral mapping estimator 414. The spectral mapping estimator 414 may be configured to generate spectral mapping parameters 462 that map the spectrum (or energies) of the non-reference high-band channel 460 to the spectrum of the synthesized non-reference high-band 458. For example, the spectral mapping estimator 414 may generate filter coefficients that map the spectrum of the non-reference high-band channel 460 to the spectrum of the synthesized non-reference high-band 458. For example, the spectral mapping estimator 414 determines the spectral mapping parameters 462 that map the spectral envelope of the synthesized non-reference high-band 458 to be substantially approximate to the spectral envelope of the non-reference high-band channel 460 (e.g., the non-reference high-band signal). The spectral mapping parameters 462 are provided to the spectral mapping quantizer 416. The spectral mapping quantizer 416 may be configured to quantize the spectral mapping parameters 462 to generate a high-band spectral mapping bitstream 464 and quantized spectral mapping parameters 466. The quantized spectral mapping parameters 466 may be applied as a filter $$\left(\text{e.g., } \frac{1}{1-\sum_i u_i z^{-i}}\right),$$

where $u_i$ is the quantized spectral mapping parameters 466.

The second portion 204*b* of the ICBWE encoder 204 includes a spectral mapping applicator 502, a gain mapping estimator and quantizer 504, and a multiplexer 590. The synthesized non-reference high-band 458 and the quantized spectral mapping parameters 466 are provided to the spectral mapping applicator 502. The spectral mapping applicator 502 may be configured to generate a spectrally shaped synthesized non-reference high-band 514 based on the synthesized non-reference high-band 458 and the quantized spectral mapping parameters 466. For example, spectral mapping applicator 502 may apply the quantized spectral mapping parameters to the synthesized non-reference high-band 458 to generate the spectrally shaped synthesized non-reference high-band 514. In other alternative implementations, the spectral mapping applicator 502 may apply the spectral mapping parameters 462 (e.g., the unquantized parameter) to the synthesized non-reference high-band 458 to generate the spectrally shaped synthesized non-reference high-band 514. The spectrally shaped synthesized non-reference high-band 514 may be used to estimate the high-band gain mapping parameters. For example, the spectrally shaped synthesized non-reference high-band 514 is provided to the gain mapping estimator and quantizer 504.

Thus, the spectral mapping estimator 414 may use a spectral shape application that filters using a filter $$h(z) = \frac{1}{1 - \sum_i u_i z^{-i}}.$$

The spectral mapping estimator 414 may estimate and quantize a value for the parameter ($u_i$). In an example implementation, the filter h(z) may be a first order filter and the spectral envelope of a signal may be approximated as a ratio of autocorrelation coefficients of lag index one (lag(1)) and lag index zero (lag(0)). If t(n) represents the $n^{th}$ sample non-reference high-band channel 460, x(n) represents the $n^{th}$ sample of the synthesized non-reference high-band 458, and y(n) represents the $n^{th}$ sample of the spectrally shaped synthesized non-reference high-band 514, then $y(n)=h(n)\circledast x(n)$, where $\circledast$ is the symbol for the signal convolution operation.

The spectral envelope of a signal s(n) may be expressed as $$\frac{r_{ss}(1)}{r_{ss}(0)},$$

where $r_{ss}(n)=\Sigma_{i=-\infty}^{\infty} s(i)*s(i+n)$ is the autocorrelation of the signal at lag(n). Because $y(n)=h(n)\circledast x(n)$, $r_{yy}(n)=r_{hh}(n)\circledast r_{xx}(n)$. To solve for ($u_i$, i=0,1) such that the envelope of y(n) is approximate to the envelope of t(n), the envelope (T) of t(n) may be equal to $$\frac{r_{tt}(1)}{r_{tt}(0)}.$$

Also, it can be shown that, $$r_{hh}(n) = \frac{u^{|n|}}{1-u^2}, \text{ when } h(z) = \frac{1}{1 - u * z^{-1}}.$$

Thus, encoder 200 may determine the envelope (T), such that $$\frac{r_{yy}(1)}{r_{yy}(0)} = T.$$

It should be noted that when the $r_{yy}$ values are expanded, there could potentially be many approximations to obtain multiple possible approximations of the value of u. Both iterative and analytical solutions can be obtained for the above equation. A non-limiting example of an analytical solution is described herein. By expanding the above equation to terms with u's exponent up to two, the result is:

$$a * u^2 + b * u + c = 0, \text{ where,}$$

$$a = 2 * T * \frac{r_{xx}(2)}{r_{xx}(0)} - \frac{r_{xx}(3)}{r_{xx}(0)} - \frac{r_{xx}(1)}{r_{xx}(0)},$$

$$b = 2 * T * \frac{r_{xx}(1)}{r_{xx}(0)} - \frac{r_{xx}(2)}{r_{xx}(0)} - 1$$

$$c = T - \frac{r_{xx}(1)}{r_{xx}(0)}$$

Two possible solutions for (u) may exist due to the nature of quadratic equations. Because the two possible solutions may be real or imaginary, if $b^2-4*a*c$ is ≥0, there are two real solutions. Otherwise, there are two imaginary solutions. In some implementations, in order to enable a controlled evolution of parameters a, b, and c to estimate the spectral mapping parameter (u), the intermediate normalized correlation values T, $r_{xx}(1)/r_{xx}(0)$, $r_{xx}(2)/r_{xx}(0)$, and $r_{xx}(3)/r_{xx}(0)$ are temporally smoothed or conditioned (e.g., using a first-order IIR filter or a moving-average filter).

Because, in general, the non-reference channel has a steeper roll-off in spectral energy at higher frequencies, smaller values of (u) may be preferred (including negative values). A smaller value of (u) envelopes the signal such that there is a steeper roll off in spectral energy at higher frequencies. According to one implementation, values of (u) whose absolute value is <1 (i.e., $|u_{final}|<1$) may be used.

If there are no real solutions, the previous frame's (u) may be used as the current frame's (u). If there are one or more real solutions and there are no real solution with an absolute value less than one, the previous frame's $u_{final}$ value may be used for the current frame. If there are one or more real solutions and there is one real solution with an absolute value less than one, the current frame may use the real solution as the $u_{final}$ value. If there are one or more real solutions and there is more than one real solution with an absolute value less than one, the current frame may use the smallest (u) value as the $u_{final}$ value or the current frame may use the (u) value that is closest to the previous frame's (u) value.

In an alternate implementation, the spectral mapping parameters may be estimated based on the spectral analysis of the non-reference high-band channel and the non-reference high-band excitation 456, to maximize the spectral match between the spectrally shaped non-reference HB signal and the non-reference HB target channel. In another implementation the spectral mapping parameters may be based on the LP analysis of the non-reference high-band channel and the synthesized high-band mid channel 520 or high-band mid channel 292.

A non-reference high-band channel 516, a synthesized high-band mid channel 520, and the high-band mid channel 292 are also provided to the gain mapping estimator and quantizer 504. The gain mapping estimator and quantizer 504 may generate a high-band gain mapping bitstream 522 and a quantized high-band gain mapping bitstream 524 based on the spectrally shaped synthesized non-reference high-band 514, the non-reference high-band channel 516, the synthesized high-band mid channel 520, and the high-band mid channel 292. For example, the gain mapping estimator and quantizer 504 may generate a set of adjustment gain parameters based on the synthesized high-band mid channel 520 and the spectrally shaped synthesized non-reference high-band 514. To illustrate, the gain mapping estimator and quantizer 504 may determine a synthesized high-band gain corresponding to a difference (or ratio) between an energy (or power) of the synthesized high-band mid channel 510 and an energy (or power) of the spectrally shaped synthesized non-reference high-band 514. The set of adjustment gain parameters may indicate the synthesized high-band gain.

The gain mapping estimator and quantizer 504 may generate the first set of adjustment gain parameters based on a set of adjustment gain parameters and a predicted set of adjustment gain parameters. For example, the first set of adjustment gain parameters may indicate a difference between the set of adjustment gain parameters and the predicted set of adjustment gain parameters. As another example, the first set of adjustment gain parameters may correspond to a product of the predicted set of adjustment gain parameters and the ratio of the first energy of the synthesized high-band mid channel 520 and the second energy of the spectrally shaped synthesized non-reference high-band 514 (e.g., first set of adjustment gain parameters=predicted set of adjustment gain parameters* (first energy of the synthesized high-band mid channel 520/second energy of the spectrally shaped synthesized non-reference high-band 514).

The high-band reference channel indicator bitstream 442, the high-band spectral mapping bitstream 464, and the high-band gain mapping bitstream 522 are provided to the multiplexer 590. The multiplexer 590 may be configured to generate the ICBWE bitstream 242 by multiplexing the high-band reference channel indicator bitstream 442, the high-band spectral mapping bitstream 464, and the high-band gain mapping bitstream 522. The ICBWE bitstream 242 may be transmitted to a decoder, such as the decoder 300 of FIG. 3A.

Figure 6:
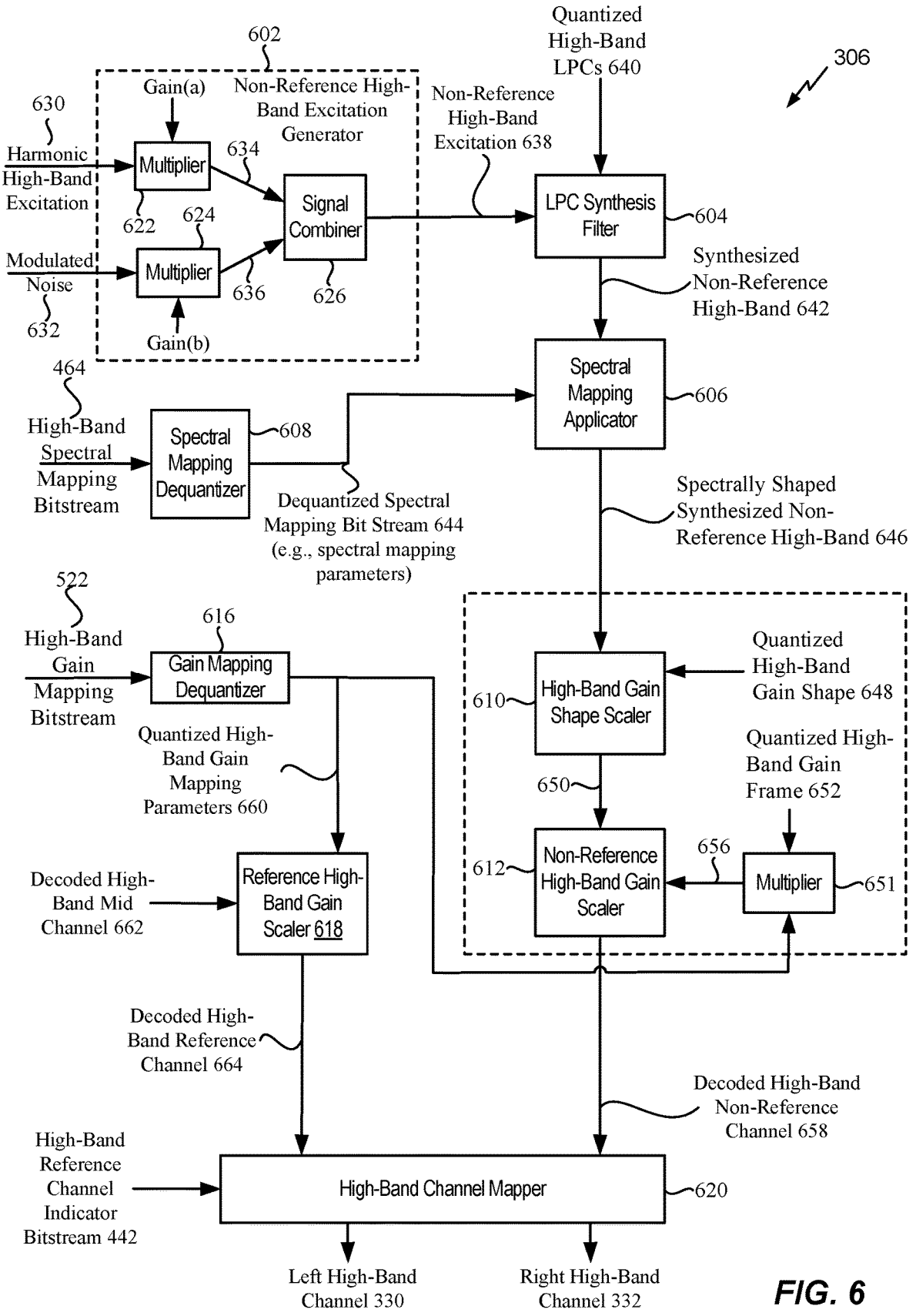
FIG. 6 is a diagram illustrating an inter-channel bandwidth extension decoder of FIG. 1.

Referring to FIG. 6, a particular implementation of the ICBWE decoder 306 is shown. The ICBWE decoder 306 includes a non-reference high-band excitation generator 602, a LPC synthesis filter 604, a spectral mapping applicator 606, a spectral mapping dequantizer 608, a high-band gain shape scaler 610, a non-reference high-band gain scaler 612, a gain mapping dequantizer 616, a reference high-band gain scaler 618, and a high-band channel mapper 620. The non-reference high-band excitation generator 602 includes a signal multiplier 622, a signal multiplier 624, and a signal combiner 626.

A harmonic high-band excitation 630 (generated from the low-band bitstream 246) is provided to the signal multiplier 622, and modulated noise 632 is provided to the signal multiplier 624. The signal multiplier 622 applies a gain (Gain(a)) to the harmonic high-band excitation 630 to generate a gain-adjusted harmonic high-band excitation 634, and the signal multiplier 624 applies a gain (Gain(b)) to the modulated noise 632 to generate gain-adjusted modulated noise 636. It should be noted that in some implementations Gain(a) and Gain(b) may be vectors with each value of the vector corresponding to a scaling factor of the corresponding signal in subframes. The mixing gains (Gain(a) and Gain(b)) may also be based on the voice factors corresponding to synthesized high-band mid channel, synthesized high-band non-reference channel, or derived from the low-band voice factor or voicing information. The mixing gains (Gain(a) and Gain(b)) may also be based on the spectral envelope corresponding to the synthesized high-band mid channel, synthesized high-band non-reference channel, or derived from the low-band voice factor or voicing information. In another alternate implementation, the mixing gains (Gain(a) and Gain(b)) may be based on the number of talkers or background sources in the signal and the voiced-unvoiced characteristic of the left (or reference, target) and right (or target, reference) channels. The gain-adjusted harmonic high-band excitation 634 and the gain-adjusted modulated noise 636 are provided to the signal combiner 626. The signal combiner 626 may be configured to combine the gain-adjusted harmonic high-band excitation 634 and the gain-adjusted modulated noise 636 to generate a non-reference high-band excitation 638. Thus, the non-reference high-band excitation 638 may be generated in a substantially similar manner as the non-reference high-band excitation 456 of the ICBWE encoder 204.

The non-reference high-band excitation 638 in provided to the LPC synthesis filter 604. The LPC synthesis filter 604 may be configured to generate a synthesized non-reference high-band 642 based on the non-reference high-band excitation 638 and quantized high-band LPCs 640 (from a bitstream transmitted from the encoder 200) of the high-band mid channel. For example, the LPC synthesis filter 604 may apply the quantized high-band LPCs 640 to the non-reference high-band excitation 638 to generate the synthesized non-reference high-band 642. The synthesized non-reference high-band 642 is provided to the spectral mapping applicator 606.

The high-band spectral mapping bitstream 464 from the encoder 200 is provided to the spectral mapping dequantizer 608. The spectral mapping dequantizer 608 may be configured to decode the high-band spectral mapping bitstream 464 to generate a dequantized spectral mapping bitstream 644. The dequantized spectral mapping bitstream 644 is provided to the spectral mapping applicator 606. The spectral mapping applicator 606 may be configured to apply the dequantized spectral mapping bitstream 644 to the synthesized non-reference high-band 642 (in a substantially similar manner as at the ICBWE encoder 204) to generate a spectrally shaped synthesized non-reference high-band 646. For example, the quantized spectral mapping bitstream 644 may be applied as a filter $$\left(\text{e.g., } \frac{1}{1-u*z^{-1}}\right),$$

where u is the quantized spectral mapping parameters. The spectrally shaped synthesized non-reference high-band 646 is provided to the high-band gain shape scaler 610.

The high-band gain shape scaler 610 may be configured to scale the spectrally shaped synthesized non-reference high-band 646 based on a quantized high-band gain shape (from a bitstream transmitted from the encoder 200) to generate a scaled signal 650. The scaled signal 650 is provided to the non-reference high-band gain scaler 612. A multiplier 651 may be configured to multiply a quantized high-band gain frame 652 (e.g., the mid channel gain frame) by quantized high-band gain mapping parameters 660 (from the high-band gain mapping bitstream 522) to generate a resulting signal 656. The resulting signal 656 may be generated by applying the product of the quantized high-band gain frame 652 and the quantized high-band gain mapping parameters 660 or using two sequential gain stages. The resulting signal 656 is provided to the non-reference high-band gain scaler 612. The non-reference high-band gain scaler 612 may be configured to scale the scaled signal 650 by the resulting signal 656 to generate a decoded high-band non-reference channel 658. The decoded high-band non-reference channel 658 is provided to the high-band channel mapper 620. According to another implementation, a predicted reference channel gain mapping parameter may be applied to the mid channel to generate the decoded high-band non-reference channel 658.

The high-band gain mapping bitstream 522 from the encoder 200 is provided to the gain mapping dequantizer 616. The gain mapping dequantizer 616 may be configured to decode the high-band gain mapping bitstream 522 to generate quantized high-band gain mapping parameters 660. The quantized high-band gain mapping parameters 660 are provided to the reference high-band gain scaler 618, and a decoded high-band mid channel 662 (generated from the high-band mid channel bitstream 244) is provided to the reference high-band gain scaler 618. The reference high-band scaler 618 may be configured to scale the decoded high-band mid channel 662 based on the quantized high-band gain mapping parameters 660 to generate a decoded high-band reference channel 664. The decoded high-band reference channel 664 is provided to the high-band channel mapper 620.

The high-band channel mapper 620 may be configured to designate the decoded high-band reference channel 664 or the decoded high-band non-reference channel 658 as the left high-band channel 330. For example, the high-band channel mapper 620 may determine whether the left high-band channel 330 is a reference channel (or non-reference channel) based on the high-band reference channel indicator bitstream 442 from the encoder 200. Using similar techniques, the high-band channel mapper 620 may be configured to designate the other of the decoded high-band reference channel 664 and the decoded high-band non-reference channel 658 as the right high-band channel 332.

The techniques described with respect to FIGS. 1-6 may enable improved high-band estimation for audio encoding and audio decoding. For example, spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the spectral mapping parameters 466 may be used at the decoder 466 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 7:
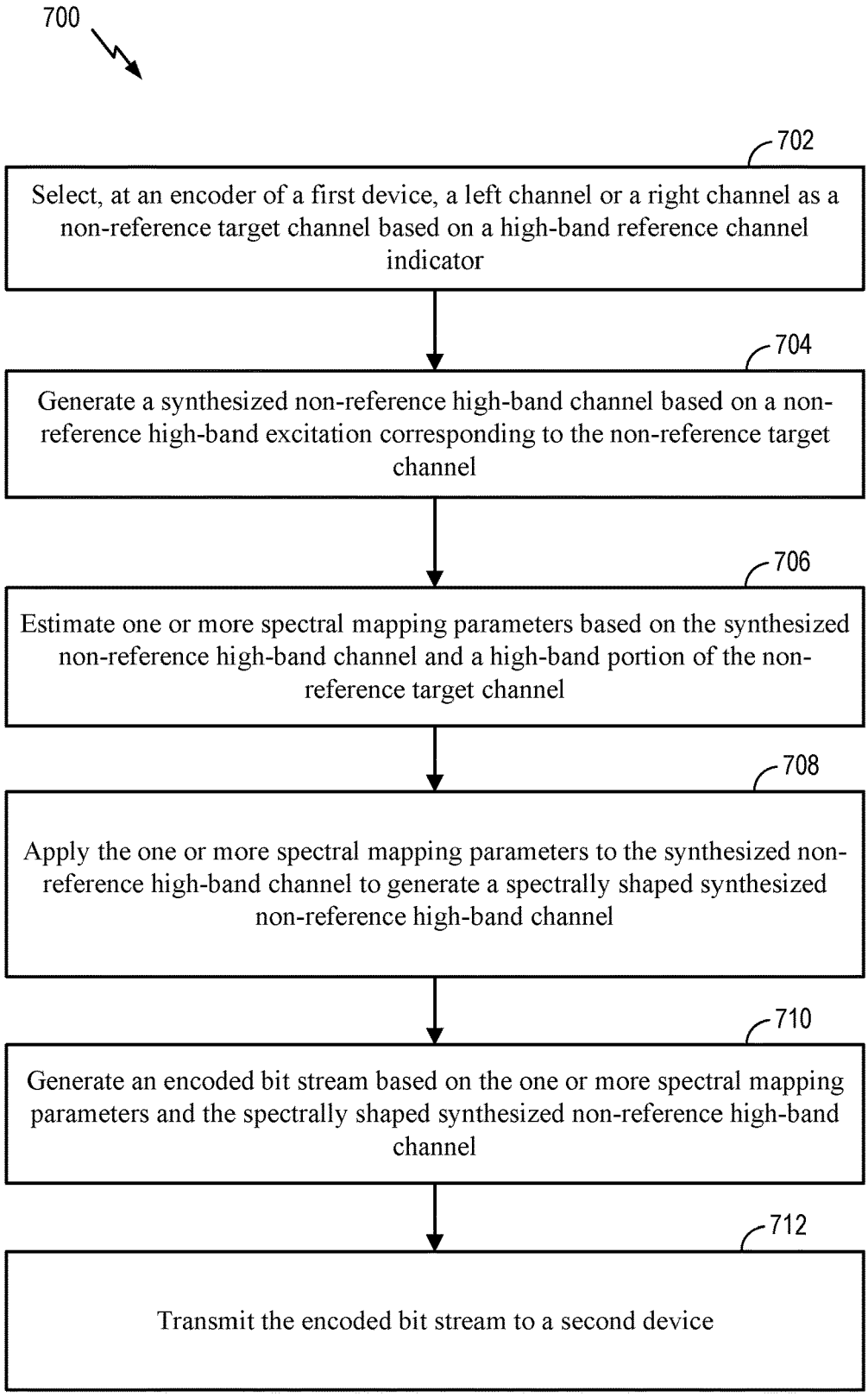
FIG. 7 is a particular example of a method of estimating one or more spectral mapping parameters.

Referring to FIG. 7, a method 700 of estimating spectral mapping parameters is shown. The method 700 may be performed by the first device 104 of FIG. 1. In particular the method 700 may be performed by the encoder 200.

The method 700 includes selecting, at an encoder of a first device, a left channel or a right channel as a non-reference target channel based on a high-band reference channel indicator, at 702. For example, referring to FIG. 4, the switch 424 may select the left channel 212 or the right channel 214 as the non-reference high-band channel 460 based on the high-band reference channel indicator 440.

The method 700 includes generating a synthesized non-reference high-band channel based on a non-reference high-band excitation corresponding to the non-reference target channel, at 704. For example, referring to FIG. 4, the LPC synthesis filter 410 may generate the synthesized non-reference high-band 458 by applying the quantized high-band LPCs 457 to the non-reference high-band excitation 456. In some implementations, the method 700 also includes generating a high-band portion of the non-reference target channel.

The method 700 also includes estimating one or more spectral mapping parameters based on the synthesized non-reference high-band channel and a high-band portion of the non-reference target channel, at 706. For example, referring to FIG. 4, the spectral mapping estimator 414 may estimate the spectral mapping parameters 462 based on the synthesized non-reference high-band 458 and the non-reference high-band channel 460.

According to one implementation, the one or more spectral mapping parameters are estimated based on a first autocorrelation value of the non-reference target channel at lag index one and a second autocorrelation value of the non-reference target channel at lag index zero. The one or more spectral mapping parameters may include a particular spectral mapping parameter of at least two spectral mapping parameter candidates. In one implementation, the particular spectral mapping parameter may correspond to a spectral mapping parameter of a previous frame if the at least two spectral mapping parameter candidates are non-real candidates. In another implementation, the particular spectral mapping parameter may correspond to a spectral mapping parameter of a previous frame if each spectral mapping parameter candidate of the at least two spectral mapping parameter candidates have an absolute value that is greater than one. In another implementation, the particular spectral mapping parameter may correspond to a spectral mapping parameter candidate having an absolute value less than one if only one spectral mapping parameter candidate of the at least two spectral mapping parameter candidates has an absolute value less than one. In another implementation, the particular spectral mapping parameter may correspond to a spectral mapping parameter candidate having a smallest value if more than one of the at least two spectral mapping parameter candidates have an absolute value less than one. In another implementation, the particular spectral mapping parameter may correspond to a spectral mapping parameter of a previous frame if more than one of the at least two spectral mapping parameter candidates have an absolute value less than one.

The method 700 also includes applying the one or more spectral mapping parameters to the synthesized non-reference high-band channel to generate a spectrally shaped synthesized non-reference high-band channel, at 708. Applying the one or more spectral parameters may correspond to filtering the synthesized non-reference high-band channel based on a spectral mapping filter. The spectrally shaped synthesized non-reference high-band channel may have a spectral envelope that is similar to a spectral envelope of the non-reference target channel. For example, referring to FIG. 5, the spectral mapping applicator 502 may apply the quantized spectral mapping parameters 466 to the synthesized non-reference high-band 458 to generate the spectrally shaped synthesized non-reference high-band 514. The spectrally shaped synthesized non-reference high-band 514 may have a spectral envelope that is similar to a spectral envelope of the non-reference high-band channel 460. The spectrally shaped synthesized non-reference high-band channel may be used to estimate a gain mapping parameter.

The method 700 also includes generating an encoded bitstream based on the one or more spectral mapping parameters and the spectrally shaped synthesized non-reference high-band channel, at 710. For example, referring to FIG. 4, the spectral mapping quantizer 416 may generate the high-band spectral mapping bitstream 464 based on the spectral mapping parameters 462. Additionally, referring to FIG. 5, the gain mapping estimator and quantizer 504 may generate the high-band gain mapping bitstream 522 based on the spectrally shaped synthesized non-reference high-band 514.

The method 700 further includes transmitting the encoded bitstream to a second device, at 712. For example, referring to FIG. 1, the transmitter 110 may transmit the ICBWE bitstream 242 (that includes the high-band spectral mapping bitstream 464) to the second device 106.

The method 700 may enable improved high-band estimation for audio encoding and audio decoding. For example, spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the spectral mapping parameters 466 may be used at the decoder 466 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 8:
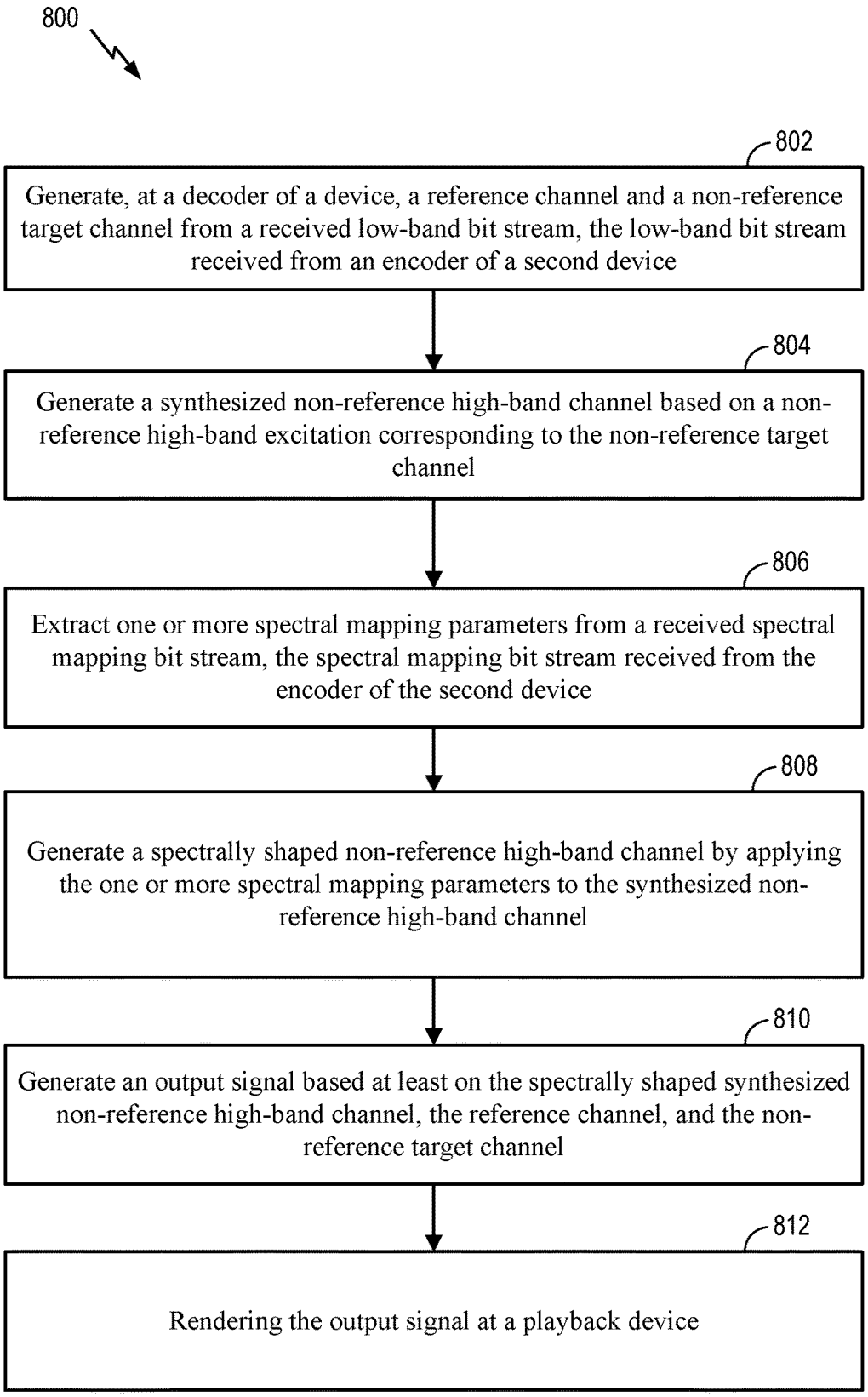
FIG. 8 is a particular example of a method of extracting one or more spectral mapping parameters.

Referring to FIG. 8, a method 800 of extracting spectral mapping parameters is shown. The method 800 may be performed by the second device 106 of FIG. 1. In particular the method 800 may be performed by the decoder 300.

The method 800 includes generating, at a decoder of a device, a reference channel and a non-reference target channel from a received bitstream, at 802. The bitstream may be received from an encoder of a second device. For example, referring to FIG. 1, the decoder 300 may generate a non-reference channel from the low-band bitstream 246. The reference channel and the non-reference target channel may be up-mixed channels generated at the decoder 300. As a non-limiting example, if the low-band reference channel is the low-band portion of the left channel, the high-band portion of the left channel may correspond to the high-band reference channel. According to one implementation, the decoder 300 may generate the left and right channels without generating the reference channel and the non-reference target channel.

The method 800 also includes generating a synthesized non-reference high-band channel based on a non-reference high-band excitation corresponding to the non-reference target channel, at 804. For example, referring to FIG. 6, the LPC synthesis filter 604 may generate the synthesized non-reference high-band 642 by applying the quantized high-band LPCs 640 to the non-reference high-band excitation 638.

The method 800 further includes extracting one or more spectral mapping parameters from a received spectral mapping bitstream, at 806. The spectral mapping bitstream may be received from the encoder of the second device. For example, referring to FIG. 6, the spectral mapping dequantizer 608 may extract the quantized spectral mapping bitstream 644 from the high-band spectral mapping bitstream 464.

The method 800 also includes generating a spectrally shaped non-reference high-band channel by applying the one or more spectral mapping parameters to the synthesized non-reference high-band channel, at 808. The spectrally shaped synthesized non-reference high-band channel may have a spectral envelope that is similar to a spectral envelope of the non-reference target channel. For example, referring to FIG. 6, the spectral mapping applicator 606 may apply the quantized spectral mapping bitstream 644 to the synthesized non-reference high-band to generate the spectrally shaped synthesized non-reference high-band 646. The spectrally shaped synthesized non-reference high-band 646 may have a spectral envelope that is similar to a spectral envelope of the non-reference target channel.

The method 800 also includes generating an output signal based at least on the spectrally shaped non-reference high-band channel, the reference channel, and the non-reference target channel, at 810. For example, referring to FIG. 1, the decoder 300 may generate at least one of the output signals 126, 128 based on the spectrally shaped synthesized non-reference high-band 646.

The method 800 further includes rendering the output signal at playback device, at 812. For example, referring to FIG. 1, the loudspeakers 142, 144 may render and output the output signals 126, 128, respectively.

The method 800 may enable improved high-band estimation for audio encoding and audio decoding. For example, spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the spectral mapping parameters 466 may be used at the decoder 466 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 9:
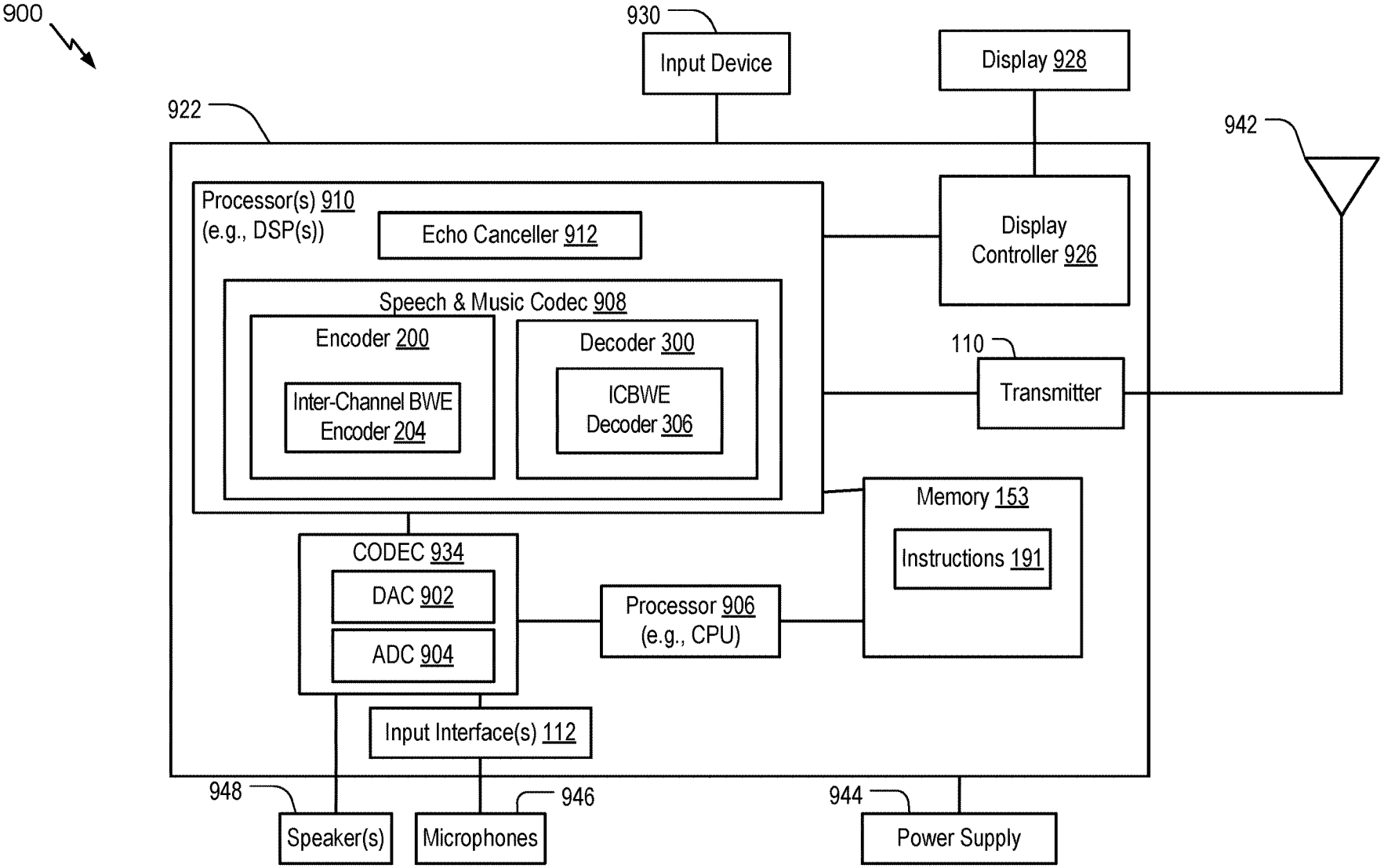
FIG. 9 is a block diagram of a particular illustrative example of a mobile device that is operable to estimate one or more spectral mapping parameters.

Referring to FIG. 9, a block diagram of a particular illustrative example of a device (e.g., a wireless communication device) is depicted and generally designated 900. In various implementations, the device 900 may have fewer or more components than illustrated in FIG. 9. In an illustrative implementation, the device 900 may correspond to the first device 104 of FIG. 1 or the second device 106 of FIG. 1. In an illustrative implementation, the device 900 may perform one or more operations described with reference to systems and methods of FIGS. 1-8.

In a particular implementation, the device 900 includes a processor 906 (e.g., a central processing unit (CPU)). The device 900 may include one or more additional processors 910 (e.g., one or more digital signal processors (DSPs)). The processors 910 may include a media (e.g., speech and music) coder-decoder (CODEC) 908, and an echo canceller 912. The media CODEC 908 may include the decoder 300, the encoder 200, or a combination thereof. The encoder 200 may include the ICBWE encoder 204, and the decoder 300 may include the ICBWE decoder 306.

The device 900 may include a memory 153 and a CODEC 934. Although the media CODEC 908 is illustrated as a component of the processors 910 (e.g., dedicated circuitry and/or executable programming code), in other implementations one or more components of the media CODEC 908, such as the decoder 300, the encoder 200, or a combination thereof, may be included in the processor 906, the CODEC 934, another processing component, or a combination thereof.

The device 900 may include the transmitter 110 coupled to an antenna 942. The device 900 may include a display 928 coupled to a display controller 926. One or more speakers 948 may be coupled to the CODEC 934. One or more microphones 946 may be coupled, via the input interface(s) 112, to the CODEC 934. In a particular implementation, the speakers 948 may include the first loudspeaker 142, the second loudspeaker 144 of FIG. 1, or a combination thereof. In a particular implementation, the microphones 946 may include the first microphone 146, the second microphone 148 of FIG. 1, or a combination thereof. The CODEC 934 may include a digital-to-analog converter (DAC) 902 and an analog-to-digital converter (ADC) 904.

The memory 153 may include instructions 191 executable by the processor 906, the processors 910, the CODEC 934, another processing unit of the device 900, or a combination thereof, to perform one or more operations described with reference to FIGS. 1-8.

One or more components of the device 900 may be implemented via dedicated hardware (e.g., circuitry), by a processor executing instructions to perform one or more tasks, or a combination thereof. As an example, the memory 153 or one or more components of the processor 906, the processors 910, and/or the CODEC 934 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 960) that, when executed by a computer (e.g., a processor in the CODEC 934, the processor 906, and/or the processors 910), may cause the computer to perform one or more operations described with reference to FIGS. 1-8. As an example, the memory 153 or the one or more components of the processor 906, the processors 910, and/or the CODEC 934 may be a non-transitory computer-readable medium that includes instructions (e.g., the instructions 960) that, when executed by a computer (e.g., a processor in the CODEC 934, the processor 906, and/or the processors 910), cause the computer perform one or more operations described with reference to FIGS. 1-8.

In a particular implementation, the device 900 may be included in a system-in-package or system-on-chip device (e.g., a mobile station modem (MSM)) 922. In a particular implementation, the processor 906, the processors 910, the display controller 926, the memory 153, the CODEC 934, and the transmitter 110 are included in a system-in-package or the system-on-chip device 922. In a particular implementation, an input device 930, such as a touchscreen and/or keypad, and a power supply 944 are coupled to the system-on-chip device 922. Moreover, in a particular implementation, as illustrated in FIG. 9, the display 928, the input device 930, the speakers 948, the microphones 946, the antenna 942, and the power supply 944 are external to the system-on-chip device 922. However, each of the display 928, the input device 930, the speakers 948, the microphones 946, the antenna 942, and the power supply 944 can be coupled to a component of the system-on-chip device 922, such as an interface or a controller.

The device 900 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

Figure 10:
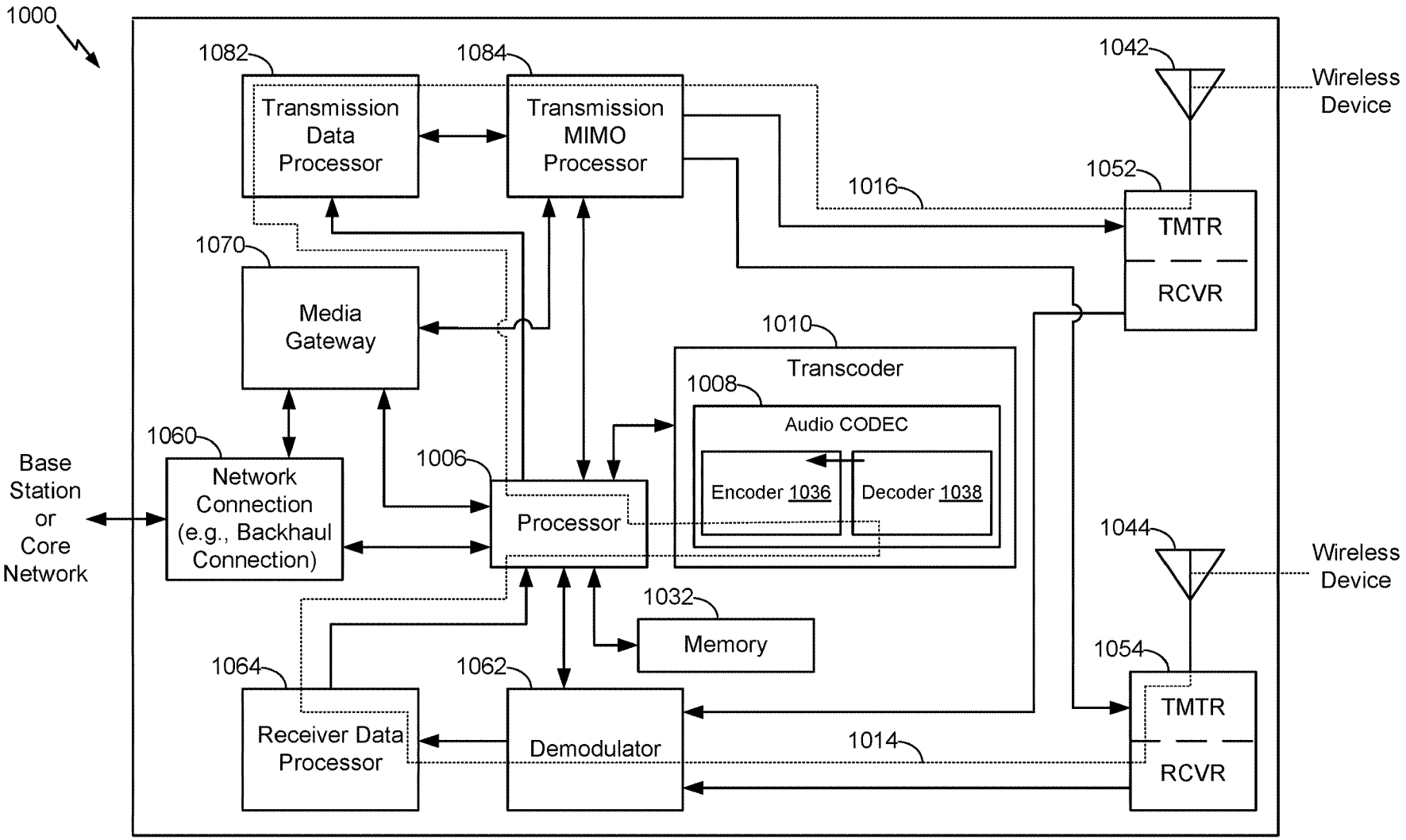
FIG. 10 is a block diagram of a base station that is operable to estimate one or more spectral mapping parameters.

Referring to FIG. 10, a block diagram of a particular illustrative example of a base station 1000 is depicted. In various implementations, the base station 1000 may have more components or fewer components than illustrated in FIG. 10. In an illustrative example, the base station 1000 may include the first device 104 or the second device 106 of FIG. 1. In an illustrative example, the base station 1000 may operate according to one or more of the methods or systems described with reference to FIGS. 1-8.

The base station 1000 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 1000 of FIG. 10.

Various functions may be performed by one or more components of the base station 1000 (and/or in other components not shown), such as sending and receiving messages and data (e.g., audio data). In a particular example, the base station 1000 includes a processor 1006 (e.g., a CPU). The base station 1000 may include a transcoder 1010. The transcoder 1010 may include an audio CODEC 1008. For example, the transcoder 1010 may include one or more components (e.g., circuitry) configured to perform operations of the audio CODEC 1008. As another example, the transcoder 1010 may be configured to execute one or more computer-readable instructions to perform the operations of the audio CODEC 1008. Although the audio CODEC 1008 is illustrated as a component of the transcoder 1010, in other examples one or more components of the audio CODEC 1008 may be included in the processor 1006, another processing component, or a combination thereof. For example, a decoder 1038 (e.g., a vocoder decoder) may be included in a receiver data processor 1064. As another example, an encoder 1036 (e.g., a vocoder encoder) may be included in a transmission data processor 1082.

The transcoder 1010 may function to transcode messages and data between two or more networks. The transcoder 1010 may be configured to convert message and audio data from a first format (e.g., a digital format) to a second format. To illustrate, the decoder 1038 may decode encoded signals having a first format and the encoder 1036 may encode the decoded signals into encoded signals having a second format. Additionally or alternatively, the transcoder 1010 may be configured to perform data rate adaptation. For example, the transcoder 1010 may down-convert a data rate or up-convert the data rate without changing a format the audio data. To illustrate, the transcoder 1010 may down-convert 64 kbit/s signals into 16 kbit/s signals.

The audio CODEC 1008 may include the encoder 1036 and the decoder 1038. The encoder 1036 may include the encoder 200 of FIG. 1. The decoder 1038 may include the decoder 300 of FIG. 1.

The base station 1000 may include a memory 1032. The memory 1032, such as a computer-readable storage device, may include instructions. The instructions may include one or more instructions that are executable by the processor 1006, the transcoder 1010, or a combination thereof, to perform one or more operations described with reference to the methods and systems of FIGS. 1-8. The base station 1000 may include multiple transmitters and receivers (e.g., transceivers), such as a first transceiver 1052 and a second transceiver 1054, coupled to an array of antennas. The array of antennas may include a first antenna 1042 and a second antenna 1044. The array of antennas may be configured to wirelessly communicate with one or more wireless devices, such as the device 1000 of FIG. 10. For example, the second antenna 1044 may receive a data stream 1014 (e.g., a bitstream) from a wireless device. The data stream 1014 may include messages, data (e.g., encoded speech data), or a combination thereof.

The base station 1000 may include a network connection 1060, such as backhaul connection. The network connection 1060 may be configured to communicate with a core network or one or more base stations of the wireless communication network. For example, the base station 1000 may receive a second data stream (e.g., messages or audio data) from a core network via the network connection 1060. The base station 1000 may process the second data stream to generate messages or audio data and provide the messages or the audio data to one or more wireless device via one or more antennas of the array of antennas or to another base station via the network connection 1060. In a particular implementation, the network connection 1060 may be a wide area network (WAN) connection, as an illustrative, non-limiting example. In some implementations, the core network may include or correspond to a Public Switched Telephone Network (PSTN), a packet backbone network, or both.

The base station 1000 may include a media gateway 1070 that is coupled to the network connection 1060 and the processor 1006. The media gateway 1070 may be configured to convert between media streams of different telecommunications technologies. For example, the media gateway 1070 may convert between different transmission protocols, different coding schemes, or both. To illustrate, the media gateway 1070 may convert from PCM signals to Real-Time Transport Protocol (RTP) signals, as an illustrative, non-limiting example. The media gateway 1070 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 1070 may include a transcode and may be configured to transcode data when codecs are incompatible. For example, the media gateway 1070 may transcode between an Adaptive Multi-Rate (AMR) codec and a G.711 codec, as an illustrative, non-limiting example. The media gateway 1070 may include a router and a plurality of physical interfaces. In some implementations, the media gateway 1070 may also include a controller (not shown). In a particular implementation, the media gateway controller may be external to the media gateway 1070, external to the base station 1000, or both. The media gateway controller may control and coordinate operations of multiple media gateways. The media gateway 1070 may receive control signals from the media gateway controller and may function to bridge between different transmission technologies and may add service to end-user capabilities and connections.

The base station 1000 may include a demodulator 1062 that is coupled to the transceivers 1052, 1054, the receiver data processor 1064, and the processor 1006, and the receiver data processor 1064 may be coupled to the processor 1006. The demodulator 1062 may be configured to demodulate modulated signals received from the transceivers 1052, 1054 and to provide demodulated data to the receiver data processor 1064. The receiver data processor 1064 may be configured to extract a message or audio data from the demodulated data and send the message or the audio data to the processor 1006.

The base station 1000 may include a transmission data processor 1082 and a transmission multiple input-multiple output (MIMO) processor 1084. The transmission data processor 1082 may be coupled to the processor 1006 and the transmission MIMO processor 1084. The transmission MIMO processor 1084 may be coupled to the transceivers 1052, 1054 and the processor 1006. In some implementations, the transmission MIMO processor 1084 may be coupled to the media gateway 1070. The transmission data processor 1082 may be configured to receive the messages or the audio data from the processor 1006 and to code the messages or the audio data based on a coding scheme, such as CDMA or orthogonal frequency-division multiplexing (OFDM), as an illustrative, non-limiting examples. The transmission data processor 1082 may provide the coded data to the transmission MIMO processor 1084.

The coded data may be multiplexed with other data, such as pilot data, using CDMA or OFDM techniques to generate multiplexed data. The multiplexed data may then be modulated (i.e., symbol mapped) by the transmission data processor 1082 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 1006.

The transmission MIMO processor 1084 may be configured to receive the modulation symbols from the transmission data processor 1082 and may further process the modulation symbols and may perform beamforming on the data. For example, the transmission MIMO processor 1084 may apply beamforming weights to the modulation symbols. The beamforming weights may correspond to one or more antennas of the array of antennas from which the modulation symbols are transmitted.

During operation, the second antenna 1044 of the base station 1000 may receive a data stream 1014. The second transceiver 1054 may receive the data stream 1014 from the second antenna 1044 and may provide the data stream 1014 to the demodulator 1062. The demodulator 1062 may demodulate modulated signals of the data stream 1014 and provide demodulated data to the receiver data processor 1064. The receiver data processor 1064 may extract audio data from the demodulated data and provide the extracted audio data to the processor 1006.

The processor 1006 may provide the audio data to the transcoder 1010 for transcoding. The decoder 1038 of the transcoder 1010 may decode the audio data from a first format into decoded audio data and the encoder 1036 may encode the decoded audio data into a second format. In some implementations, the encoder 1036 may encode the audio data using a higher data rate (e.g., up-convert) or a lower data rate (e.g., down-convert) than received from the wireless device. In other implementations, the audio data may not be transcoded. Although transcoding (e.g., decoding and encoding) is illustrated as being performed by a transcoder 1010, the transcoding operations (e.g., decoding and encoding) may be performed by multiple components of the base station 1000. For example, decoding may be performed by the receiver data processor 1064 and encoding may be performed by the transmission data processor 1082. In other implementations, the processor 1006 may provide the audio data to the media gateway 1070 for conversion to another transmission protocol, coding scheme, or both. The media gateway 1070 may provide the converted data to another base station or core network via the network connection 1060.

Encoded audio data generated at the encoder 1036, such as transcoded data, may be provided to the transmission data processor 1082 or the network connection 1060 via the processor 1006. The transcoded audio data from the transcoder 1010 may be provided to the transmission data processor 1082 for coding according to a modulation scheme, such as OFDM, to generate the modulation symbols. The transmission data processor 1082 may provide the modulation symbols to the transmission MIMO processor 1084 for further processing and beamforming. The transmission MIMO processor 1084 may apply beamforming weights and may provide the modulation symbols to one or more antennas of the array of antennas, such as the first antenna 1042 via the first transceiver 1052. Thus, the base station 1000 may provide a transcoded data stream 1016, that corresponds to the data stream 1014 received from the wireless device, to another wireless device. The transcoded data stream 1016 may have a different encoding format, data rate, or both, than the data stream 1014. In other implementations, the transcoded data stream 1016 may be provided to the network connection 1060 for transmission to another base station or a core network.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a first apparatus includes means for selecting a left channel or a right channel as a non-reference target channel based on a high-band reference channel indicator. For example, the means for selecting may include the encoder 200 of FIGS. 1, 2A, and 9, the ICBWE encoder 204 of FIGS. 1, 2A, 4, and 5, the switch 424 of FIG. 4, the CODEC 908 of FIG. 9, the processor 906 of FIG. 9, the instructions 191 executable by a processor, the encoder 1036 of FIG. 10, one or more other devices, circuits, or any combination thereof.

The first apparatus also includes means for generating a synthesized non-reference high-band channel based on a non-reference high-band excitation corresponding to the non-reference target channel. For example, the means for generating the synthesized non-reference high-band channel may include the encoder 200 of FIGS. 1, 2A, and 9, the ICBWE encoder 204 of FIGS. 1, 2A, 4, and 5, the LPC synthesis filter 410 of FIG. 4, the CODEC 908 of FIG. 9, the processor 906 of FIG. 9, the instructions 191 executable by a processor, the encoder 1036 of FIG. 10, one or more other devices, circuits, or any combination thereof.

The first apparatus also includes means for estimating one or more spectral mapping parameters based on the synthesized non-reference high-band channel and a high-band portion of the non-reference target channel. For example, the means for estimating may include the encoder 200 of FIGS. 1, 2A, and 9, the ICBWE encoder 204 of FIGS. 1, 2A, 4, and 5, the spectral mapping estimator 414 of FIG. 4, the CODEC 908 of FIG. 9, the processor 906 of FIG. 9, the instructions 191 executable by a processor, the encoder 1036 of FIG. 10, one or more other devices, circuits, or any combination thereof.

The first apparatus also includes means for applying the one or more spectral mapping parameters to the synthesized non-reference high-band channel to generate a spectrally shaped synthesized non-reference high-band channel. For example, the means for applying may include the encoder 200 of FIGS. 1, 2A, and 9, the ICBWE encoder 204 of FIGS. 1, 2A, 4, and 5, the spectral mapping applicator 502 of FIG. 5, the CODEC 908 of FIG. 9, the processor 906 of FIG. 9, the instructions 191 executable by a processor, the encoder 1036 of FIG. 10, one or more other devices, circuits, or any combination thereof.

The first apparatus also includes means for generating an encoded bitstream based on the one or more spectral mapping parameters and the spectrally shaped synthesized non-reference high-band channel. For example, the means for generating the spectral mapping parameter bitstream may include the encoder 200 of FIGS. 1, 2A, and 9, the ICBWE encoder 204 of FIGS. 1, 2A, 4, and 5, the spectral mapping quantizer 416 of FIG. 4, the CODEC 908 of FIG. 9, the processor 906 of FIG. 9, the instructions 191 executable by a processor, the encoder 1036 of FIG. 10, one or more other devices, circuits, or any combination thereof.

The first apparatus also includes means for transmitting the encoded bitstream to a second device. For example, the means for transmitting may include the transmitter 110 of FIGS. 1 and 9, the transceiver 1052 of FIG. 10, one or more other devices, circuits, or any combination thereof.

In conjunction with the described techniques, a second apparatus includes means for generating reference channel and a non-reference target channel from a received low-band bitstream. For example, the means for generating the non-reference channel may include the decoder 300 of FIGS. 1, 3A, and 9, the decoder 1038 of FIG. 10, one or more other devices, circuits, or any combination thereof.

The second apparatus also includes means for generating a synthesized non-reference high-band channel based on a non-reference high-band excitation corresponding to the non-reference target channel. For example, the means for generating the synthesized non-reference high-band channel may include the decoder 300 of FIGS. 1, 3A, and 9, the ICBWE decoder 306 of FIGS. 1, 3A, 6, and 9, the LPC synthesis filter 604 of FIG. 6, the decoder 1038 of FIG. 10, one or more other devices, circuits, or any combination thereof.

The second apparatus also includes means for extracting one or more spectral mapping parameters from a received spectral mapping bitstream. For example, the means for extracting may include the decoder 300 of FIGS. 1, 3A, and 9, the ICBWE decoder 306 of FIGS. 1, 3A, 6, and 9, the spectral mapping dequantizer 608 of FIG. 6, the decoder 1038 of FIG. 10, one or more other devices, circuits, or any combination thereof.

The second apparatus also includes means for generating a spectrally shaped synthesized non-reference high-band channel by applying the one or more spectral mapping parameters to the synthesized non-reference high-band channel. For example, the means for generating the a spectrally shaped synthesized non-reference high-band channel may include the decoder 300 of FIGS. 1, 3A, and 9, the ICBWE decoder 306 of FIGS. 1, 3A, 6, and 9, the spectral mapping applicator 606 of FIG. 6, the decoder 1038 of FIG. 10, one or more other devices, circuits, or any combination thereof.

The second apparatus also includes means for generating an output signal based at least on the spectrally shaped non-reference high-band channel, the reference channel, and the non-reference target channel. For example, the means for generating the output signal may include the decoder 300 of FIGS. 1, 3A, and 9, the ICBWE decoder 306 of FIGS. 1, 3A, 6, and 9, the decoder 1038 of FIG. 10, one or more other devices, circuits, or any combination thereof.

The second apparatus also includes means for rendering the output signal. For example, the means for rendering the output signal may include the first loudspeaker 142 of FIG. 1, the second loudspeaker 144 of FIG. 1, the speaker 948 of FIG. 9, one or more other devices, circuits, or any combination thereof.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

an encoder configured to:

select a left channel or a right channel as a non-reference target channel based on a high-band reference channel indicator;

generate a high-band portion of the non-reference target channel;

generate a synthesized non-reference high-band channel based on a non-reference high-band excitation corresponding to the non-reference target channel;

estimate one or more spectral mapping parameters based on the synthesized non-reference high-band channel and the high-band portion of the non-reference target channel;

apply the one or more spectral mapping parameters to the synthesized non-reference high-band channel to generate a spectrally shaped synthesized non-reference high-band channel;

estimate a gain mapping parameter based on the spectrally shaped synthesized non-reference high-band channel, the gain mapping parameter distinct from the one or more spectral mapping parameters; and generate an encoded bitstream based on the one or more spectral mapping parameters, the gain mapping parameter, and the spectrally shaped synthesized non-reference high-band channel; and a transmitter configured to transmit the encoded bitstream to a second device.

2. The device of claim 1, wherein the encoder is further configured to:

apply a first gain to a harmonic high-band excitation to generate a gain-adjusted harmonic high-band excitation;

apply a second gain to modulated noise to generate gain-adjusted modulated noise; and combine the gain-adjusted harmonic high-band excitation and the gain-adjusted modulated noise to generate the non-reference high-band excitation.

3. The device of claim 1, wherein the synthesized non-reference high-band channel is generated using a linear prediction coefficient synthesis filter.

4. The device of claim 1, wherein the encoder is further configured to filter the synthesized non-reference high-band channel based on a spectral-mapping filter.

5. The device of claim 1, wherein the gain mapping parameter is further based on a high-band mid channel, a synthesized high-band mid channel, and a non-reference high-band channel.

6. The device of claim 1, wherein the one or more spectral mapping parameters are estimated based on a first autocorrelation value of the non-reference target channel at lag index one and a second autocorrelation value of the non-reference target channel at lag index zero.

7. The device of claim 1, wherein the one or more spectral mapping parameters include a spectral mapping parameter corresponding to a criteria satisfied by at least two spectral mapping parameter candidates to match a spectral shape of the non-reference target channel and a spectral shape of the spectrally shaped synthesized non-reference high-band channel.

8. The device of claim 7, wherein the spectral mapping parameter corresponds to a spectral mapping parameter of a previous frame if the at least two spectral mapping parameter candidates are non-real candidates.

9. The device of claim 7, wherein the spectral mapping parameter corresponds to a spectral mapping parameter of a previous frame if each spectral mapping parameter candidate of the at least two spectral mapping parameter candidates has an absolute value that is greater than one.

10. The device of claim 7, wherein the spectral mapping parameter corresponds to a spectral mapping parameter candidate having an absolute value less than one if only one spectral mapping parameter candidate of the at least two spectral mapping parameter candidates has an absolute value less than one.

11. The device of claim 7, wherein the spectral mapping parameter corresponds to a spectral mapping parameter candidate having a smallest value if more than one of the at least two spectral mapping parameter candidates have an absolute value less than one.

12. The device of claim 7, wherein the spectral mapping parameter corresponds to a spectral mapping parameter of a previous frame if more than one of the at least two spectral mapping parameter candidates have an absolute value less than one.

13. The device of claim 1, wherein the encoded bitstream corresponds to an inter-channel bandwidth extension (ICBWE) bitstream, the ICBWE bitstream based on a high-band reference channel indicator bitstream, a high-band spectral mapping bitstream, and a high-band gain mapping bitstream.

14. The device of claim 1, wherein the encoder and the transmitter are integrated into a mobile device.

15. The device of claim 1, wherein the encoder and the transmitter are integrated into a base station.

16. A method of encoding audio data, the method comprising:

selecting, at an encoder of a first device, a left channel or a right channel as a non-reference target channel based on a high-band reference channel indicator;

generating a high-band portion of the non-reference target channel;

generating a synthesized non-reference high-band channel based on a non-reference high-band excitation corresponding to the non-reference target channel;

estimating one or more spectral mapping parameters based on the synthesized non-reference high-band channel and the high-band portion of the non-reference target channel;

applying the one or more spectral mapping parameters to the synthesized non-reference high-band channel to generate a spectrally shaped synthesized non-reference high-band channel;

estimating a gain mapping parameter based on the spectrally shaped synthesized non-reference high-band channel, the gain mapping parameter distinct from the one or more spectral mapping parameters;

generating an encoded bitstream based on the one or more spectral mapping parameters, the gain mapping parameter, and the spectrally shaped synthesized non-reference high-band channel; and transmitting the encoded bitstream to a second device.

17. The method of claim 16, further comprising:

applying a first gain to a harmonic high-band excitation to generate a gain-adjusted harmonic high-band excitation;

applying a second gain to modulated noise to generate gain-adjusted modulated noise; and combining the gain-adjusted harmonic high-band excitation and the gain-adjusted modulated noise to generate the non-reference high-band excitation.

18. The method of claim 16, further comprising generating the synthesized non-reference high-band channel based on a linear prediction coefficient synthesis filter.

19. The method of claim 16, wherein the one or more spectral mapping parameters include a spectral mapping parameter corresponding to a criteria satisfied by at least two spectral mapping parameter candidates to match a spectral shape of the non-reference target channel and a spectral shape of the spectrally shaped synthesized non-reference high-band channel.

20. The method of claim 19, wherein the spectral mapping parameter corresponds to a spectral mapping parameter of a previous frame if the at least two spectral mapping parameter candidates are non-real candidates.

21. The method of claim 19, wherein the spectral mapping parameter corresponds to a spectral mapping parameter of a previous frame if each spectral mapping parameter candidate of the at least two spectral mapping parameter candidates has an absolute value that is greater than one.

22. The method of claim 19, wherein the spectral mapping parameter corresponds to a spectral mapping parameter candidate having an absolute value less than one if only one spectral mapping parameter candidate of the at least two spectral mapping parameter candidates has an absolute value less than one.

23. The method of claim 19, wherein the spectral mapping parameter corresponds to a spectral mapping parameter candidate having a smallest value if more than one of the at least two spectral mapping parameter candidates have an absolute value less than one.

24. The method of claim 19, wherein the spectral mapping parameter corresponds to a spectral mapping parameter of a previous frame if more than one of the at least two spectral mapping parameter candidates have an absolute value less than one.

25. The method of claim 16, wherein estimating the one or more spectral mapping parameters and applying the one or more spectral mapping parameters are performed at a mobile device.

26. The method of claim 16, wherein estimating the one or more spectral mapping parameters and applying the one or more spectral mapping parameters are performed at a base station.

27. A device comprising:

mean for selecting a left channel or a right channel as a non-reference target channel based on a high-band reference channel indicator;

means for generating a high-band portion of the non-reference target channel;

means for generating a synthesized non-reference high-band channel based on a non-reference high-band excitation corresponding to the non-reference target channel;

means for estimating one or more spectral mapping parameters based on the synthesized non-reference high-band channel and the high-band portion of the non-reference target channel;

means for applying the one or more spectral mapping parameters to the synthesized non-reference high-band channel to generate a spectrally shaped synthesized non-reference high-band channel;

means for estimating a gain mapping parameter based on the spectrally shaped synthesized non-reference high-band channel, the gain mapping parameter distinct from the one or more spectral mapping parameters;

means for generating an encoded bitstream based on the one or more spectral mapping parameters, the gain mapping parameter, and the spectrally shaped synthesized non-reference high-band channel; and means for transmitting the spectral mapping parameter bitstream to a second device.

28. The device of claim 27, wherein the means for estimating the one or more spectral mapping parameters and the means for applying the one or more spectral mapping parameters are integrated into a mobile device.

29. The device of claim 27, wherein the means for estimating the one or more spectral mapping parameters and the means for applying the one or more spectral mapping parameters are integrated into a base station.

30. A device comprising:

a decoder configured to:

generate a reference channel and a non-reference target channel from a received low-band bitstream, the low-band bitstream received from an encoder of a second device;

generate a synthesized non-reference high-band channel based on a non-reference high-band excitation corresponding to the non-reference target channel;

extract one or more spectral mapping parameters from a received spectral mapping bitstream, the spectral mapping bitstream received from the encoder of the second device;

extract a gain mapping parameter from a received high-band gain mapping bitstream, the high-band gain mapping bitstream received from the encoder of the second device, and the gain mapping parameter distinct from the one or more spectral mapping parameters;

generate a spectrally shaped synthesized non-reference high-band channel by applying the one or more spectral mapping parameters and the gain mapping parameter to the synthesized non-reference high-band channel; and generate an output signal based at least on the spectrally shaped synthesized non-reference high-band channel, the reference channel, and the non-reference target channel.

31. The device of claim 30, further comprising a playback device configured to render the output signal.

32. The device of claim 30, wherein the encoder is further configured to:

scale the spectrally shaped synthesized non-reference high-band channel based on a quantized high-band gain shape to generate a scaled signal; and generate a decoded high-band non-reference channel based on the scaled signal, wherein the output signal is based at least on the decoded high-band non-reference channel.

33. The device of claim 30, wherein the decoder is integrated into a mobile device.

34. The device of claim 30, wherein the decoder is integrated into a base station.

* * * * *